US009753433B2

(12) United States Patent
Tanabe et al.

(10) Patent No.: US 9,753,433 B2
(45) Date of Patent: Sep. 5, 2017

(54) MECHANICAL COMPONENT, MOVEMENT, AND TIMEPIECE

(71) Applicant: SEIKO INSTRUMENTS INC., Chiba-shi, Chiba (JP)

(72) Inventors: Sachiko Tanabe, Chiba (JP); Takashi Niwa, Chiba (JP); Masahiro Nakajima, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 0 days.

(21) Appl. No.: 14/841,959

(22) Filed: Sep. 1, 2015

(65) Prior Publication Data

US 2016/0077490 A1 Mar. 17, 2016

(30) Foreign Application Priority Data

Sep. 12, 2014 (JP) ..... 2014-186362
Jul. 6, 2015 (JP) ..... 2015-135596

(51) Int. Cl.
*G04B 13/02* (2006.01)

(52) U.S. Cl.
CPC ..... *G04B 13/02* (2013.01); *G04B 13/021* (2013.01)

(58) Field of Classification Search
CPC ..... G04B 13/00; G04B 13/02; G04B 13/021; G04B 13/022; G04B 13/026
See application file for complete search history.

(56) References Cited

U.S. PATENT DOCUMENTS 2,721,443 A * 10/1955 Junghans ..... G04B 31/04 368/326
3,672,150 A * 6/1972 Yasuda ..... G04B 19/247 368/37
4,206,379 A * 6/1980 Onda ..... G04C 13/11 310/156.12
6,677,692 B1 1/2004 Sato et al. ..... 310/89
8,206,029 B2 * 6/2012 Vaucher ..... G04B 13/022 29/893.2
9,128,463 B2 * 9/2015 Conus ..... G04B 13/022
2006/0055097 A1 * 3/2006 Conus ..... G04B 17/066 267/273
2008/0112274 A1 * 5/2008 Bitterli ..... G04B 13/026 368/238
2009/0263182 A1 * 10/2009 Bannier ..... G04B 13/02 403/242
2012/0090933 A1 * 4/2012 Conus ..... G04B 13/022 188/371
2014/0160901 A1 * 6/2014 Cusin ..... G04B 13/022 368/127

* cited by examiner

*Primary Examiner* — Vit W Miska
(74) *Attorney, Agent, or Firm* — Adams & Wilks

(57) ABSTRACT

A mechanical component includes a component main body having a through-hole through which a shaft member is passed, and a forcing-in portion made of metal material formed on the inner surface of the through-hole and fixed to the shaft member through the forcing-in of the shaft member. The component main body has a retaining recess and the forcing-in portion fills the inner space of the retaining recess so that the retaining recess constitutes an anchor structure regulating displacement of the forcing-in portion with respect to the component main body.

18 Claims, 14 Drawing Sheets

MECHANICAL COMPONENT, MOVEMENT, AND TIMEPIECE

BACKGROUND OF THE INVENTION

1. Field of the Invention

The present invention relates to a mechanical component, a mechanical component manufacturing method, a movement, and a timepiece.

2. Description of the Related Art

A precision machine such as a mechanical timepiece employs a mechanical component such as a cogwheel, which rotates around a shaft member.

As a connection structure between a mechanical component and a shaft member, there exists a structure in which a forcing-in portion formed of metal is formed at a through-hole of the mechanical component, with the forcing-in portion being forced into the forcing-in portion (See, for example, JP-A-11-304956 (Patent Literature 1)).

A mechanical component of this type is formed thin, so that it is subject to the influence of stress generated when the shaft member is forced in; however, the mechanical component having the forcing-in portion can mitigate the stress due to the forcing-in portion.

In the mechanical component disclosed in Patent Literature 1, a metal film is formed over the entire surface through plating, and, of this metal film, the portion formed on the inner surface of the through-hole can function as the forcing-in portion mitigating the stress due to the forcing-in of the shaft member.

However, the above mechanical component, in which the metal film on the inner surface of the through-hole is formed by plating, has the following problems:

When the metal film is thin, the plastic deformation amount of this metal film is small, and, in particular, when a brittle material (such as a ceramic material) is used for the mechanical component, the component is subject to breakage. Further, the metal film has the possibility of being separated from the inner surface of the through-hole. The separation of the film can cause axial deviation. Further, the mechanical component of the above structure is subject to rotation looseness.

Further, the metal film is formed over the entire surface of the mechanical component, so that, when the metal film on the inner surface of the through-hole is made thick, the outer diameter of the mechanical component increases; thus, there is a fear of its relationship with other mechanical components being adversely affected.

SUMMARY OF THE INVENTION

It is an aspect of the present application to provide a mechanical component, a mechanical component manufacturing method, a movement, and a timepiece allowing the forcing-in portion to be firmly fixed to the shaft member, providing a sufficient buffer effect, and capable of enhancing the dimensional precision.

In accordance with the present application, there is provided a mechanical component including: a component main body having a through-hole through which the shaft member is passed; and a forcing-in portion formed on the inner surface of the through-hole and fixed to the shaft member through the forcing-in of the shaft member, wherein, on the inner surface of the through-hole, there is formed a retaining recess constituting an anchor structure regulating displacement of the forcing-in portion with respect to the component main body by retaining at least a part of the forcing-in portion, with the forcing-in portion being formed of a metal material.

In this construction, there is formed in the component main body a retaining recess constituting an anchor structure regulating displacement of the forcing-in portion, so that it is possible to enhance the fixation strength of the forcing-in portion with respect to the component main body, making it difficult for rotation looseness to occur during the operation of the mechanical component. Thus, it is possible to reliably transmit the torque of the shaft member to the component main body, making it possible to improve the timekeeping accuracy of the timepiece employing this mechanical component.

The retaining recess retains at least a part of the forcing-in portion, so that it is possible to enlarge the radial dimension (thickness) of the forcing-in portion at this portion. Thus, it is possible to secure a sufficient forcing-in margin, and to enhance the buffer effect. Thus, even when a brittle material is used for the component main body, it is possible to prevent breakage of the mechanical component due to the stress when the shaft member is forced in.

Further, it is possible to enlarge the radial dimension (thickness) of the forcing-in portion, so that it is possible to make it difficult for the separation of the forcing-in portion to occur.

Further, the forcing-in portion is formed of a metal material, so that it can be formed through electroforming. As a result, it is possible to form the forcing-in portion without allowing the metal material to adhere to the outer peripheral surface of the component main body, so that there is no fear of the outer diameter dimension of the mechanical component increasing. Thus, it is possible to enhance the dimensional precision of the mechanical component and to improve the timekeeping accuracy of the timepiece.

It is desirable for the retaining recess to regulate inward displacement of the forcing-in portion by making the width dimension thereof at a first position smaller than the width dimension thereof at a second position on the outer peripheral side of the first position.

In this construction, it is possible to further enhance the fixation strength of the forcing-in portion with respect to the component main body, making it possible to prevent rotation looseness during the operation of the mechanical component.

It is desirable for the retaining recess to have a receiving step portion the peripheral dimension of which increases discontinuously toward the exterior; and it is desirable for the forcing-in portion to have an abutment step portion abutting the receiving step portion.

In this construction, it is possible to further enhance the fixation strength of the forcing-in portion with respect to the component main body, and to prevent rotation looseness during the operation of the mechanical component.

It is desirable for the forcing-in portion to be divided by at least one position in the peripheral direction of the component main body.

In this construction, it is possible to make it difficult for peripheral displacement of the forcing-in portion to occur, to further enhance the fixation strength of the forcing-in portion with respect to the component main body, and to prevent rotation looseness during the operation of the mechanical component.

It is desirable for the component main body to have a receiving recess receiving a swollen deformed portion of the forcing-in portion generated through the forcing-in of the shaft member.

In this construction, it is possible to mitigate the stress accompanying the forcing-in of the shaft member. Thus, no excessive force is likely to be applied to the component main body, making it possible to reliably prevent breakage of the component main body.

It is desirable for a part of the forcing-in portion to protrude from the inner surface of the through-hole.

In this construction, it is possible to reliably retain the shaft member.

The forcing-in portion may have a displacement regulating structure regulating displacement in the thickness direction with respect to the component main body.

In this construction, it is possible to regulate positional deviation of the shaft member, so that it is possible to prevent breakage of the mechanical component, and to improve the timekeeping accuracy of the timepiece employing this mechanical component.

It is desirable for the component main body to be formed of a brittle material.

The movement of the present application is equipped with the mechanical component.

In this construction, it is possible to provide a movement of high timekeeping accuracy.

The timepiece of the present application is equipped with the mechanical component.

In this construction, it is possible to provide a timepiece of high timekeeping accuracy.

In accordance with the present application, there is provided a method of manufacturing a mechanical component including: a component main body having a through-hole through which the shaft member is passed; and a forcing-in portion formed on the inner surface of the through-hole and fixed to the shaft member through the forcing-in of the shaft member, wherein, on the inner surface of the through-hole, there is formed a retaining recess constituting an anchor structure regulating displacement of the forcing-in portion with respect to the component main body by retaining at least a part of the forcing-in portion, the method including the steps of: forming, on at least one surface of a base member constituting the mechanical component a mask having an inner configuration corresponding to the configuration of the forcing-in portion and an outer configuration corresponding to the outer configuration of the component main body, and forming in the base member the retaining recess in conformity with the inner configuration of the mask; forming the forcing-in portion consisting of a metal material by electroforming so that a part thereof may be retained by the retaining recess; and removing an unnecessary portion of the base member in conformity with the outer configuration of the mask.

According to the present application, the forcing-in portion is formed and the outer configuration of the component main body is determined by using a common mask, so that it is possible to enhance the coaxiality of the component main body with respect to the shaft member. Further, it is possible to enhance the dimensional precision in the radial direction.

Thus, axial deviation with respect to the shaft member does not easily occur, making it possible to prevent offset during the operation of the mechanical component. Thus, it is possible to enhance the timekeeping accuracy of the timepiece employing this mechanical component.

In the mechanical component of the present application, the component main body has a retaining recess constituting an anchor structure regulating displacement of the forcing-in portion, so that it is possible to enhance the fixation strength of the forcing-in portion with respect to the component main body, and to make it difficult for rotation looseness to occur during the operation of the mechanical component. Thus, it is possible to reliably transmit the torque of the shaft member to the component main body, making it possible to improve the timekeeping accuracy of the timepiece employing this mechanical component.

Further, at least a part of the forcing-in portion is retained in the retaining recess, so that it is possible to enlarge the radial dimension (thickness) of the forcing-in portion at this portion. Thus, it is possible to secure a sufficient forcing-in margin, and to enhance the buffer effect. Thus, even when a brittle material is used for the component main body, it is possible to prevent breakage of the mechanical component due to the stress when the shaft member is forced in.

Further, it is possible to enlarge the radial dimension (thickness) of the forcing-in portion, so that separation of the forcing-in portion does not easily occur.

Further, the forcing-in portion is formed of a metal material, so that it can be formed by electroforming. As a result, it is possible to form the forcing-in portion without allowing the metal material to adhere to the outer peripheral surface of the component main body, so that there is no fear of the outer diameter dimension of the mechanical component being enlarged. Thus, it is possible to enhance the dimensional precision of the mechanical component, and to improve the timekeeping accuracy of the timepiece.

In the mechanical component manufacturing method of the present application, the forming-in portion is formed, and the outer configuration of the component main body is determined by using a common mask, so that it is possible to enhance the coaxiality of the component main body with respect to the shaft member. Further, it is possible to enhance the dimensional precision in the radial direction.

Thus, axial deviation with respect to the shaft member does not easily occur, making it possible to prevent offset during the operation of the mechanical component. Thus, it is possible to enhance the timekeeping accuracy of the timepiece employing this mechanical component.

DETAILED DESCRIPTION OF THE PREFERRED EMBODIMENTS

First Embodiment, Mechanical Component

A mechanical component 10 according to the first embodiment of the present invention will be described.

Figure 1A:
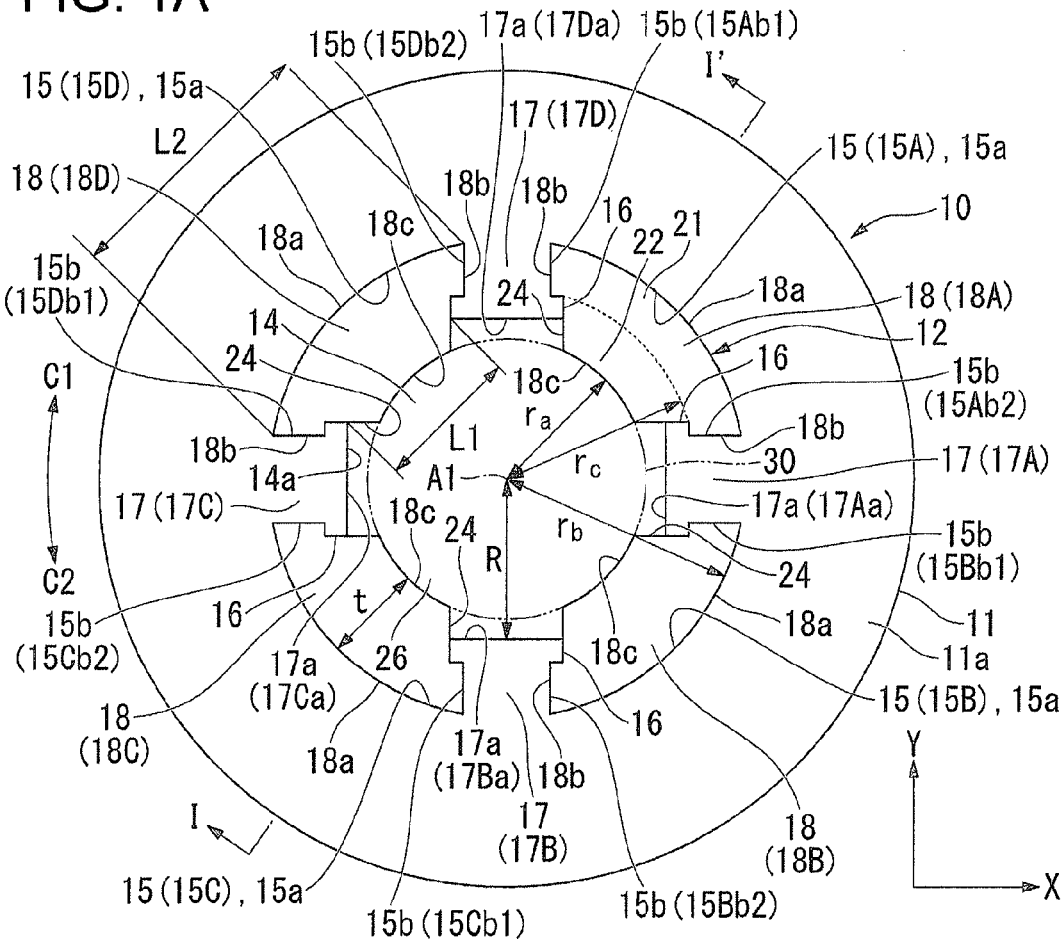
FIGS. 1(*a*)-1(*b*) are diagrams illustrating a mechanical component according to a first embodiment of the present invention; wherein FIG. 1(*a*) is an overall plan view, and FIG. 1(*b*) is an enlarged plan view of a part of FIG. 1(*a*).
Figure 1B:
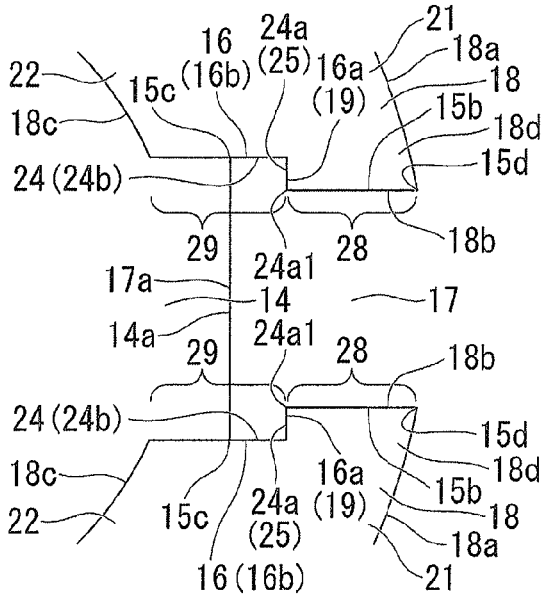
Figure 2:
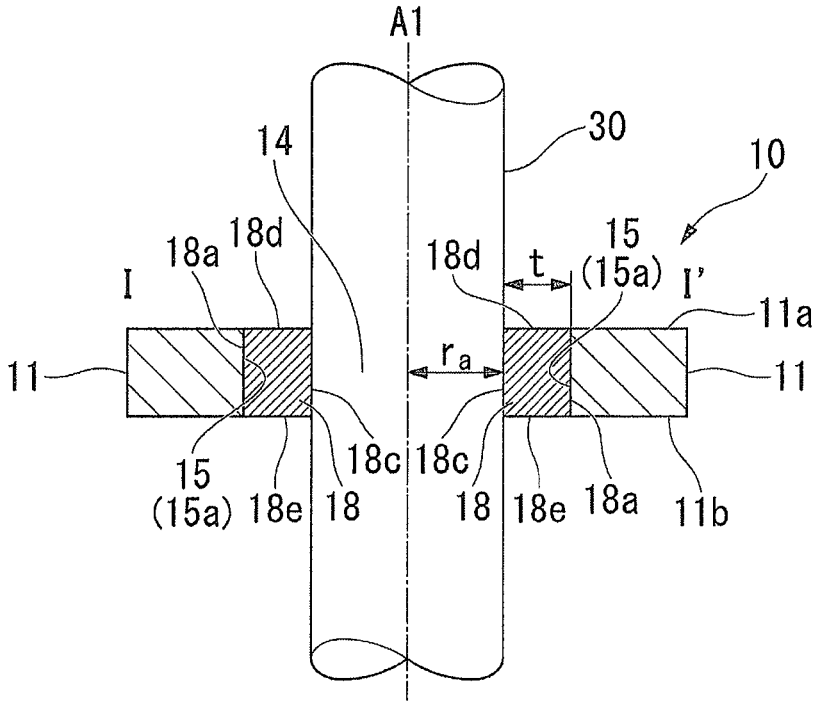
FIG. 2 is a sectional view of the mechanical component of FIG. 1; it is a sectional view taken along line I-I' of FIG. 1(*a*).
Figure 3A:
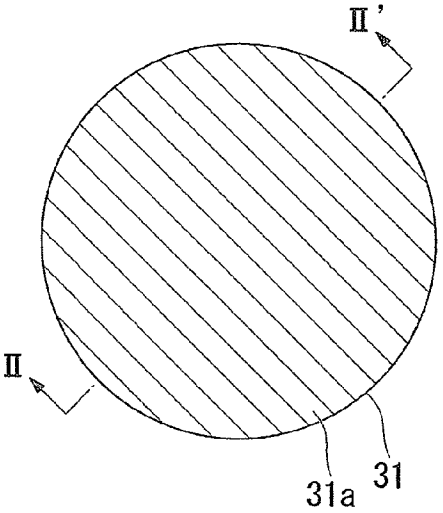
FIGS. 3(*a*)-(*f*) are explanatory views of a mechanical component manufacturing method according to an embodiment of the present invention.
Figure 3B:
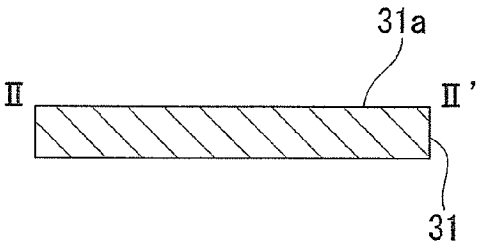
Figure 3C:
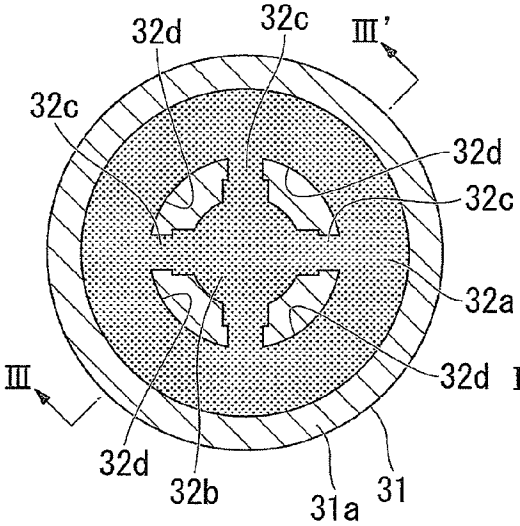
Figure 3D:
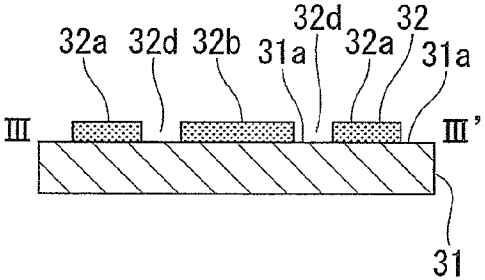
Figure 3E:
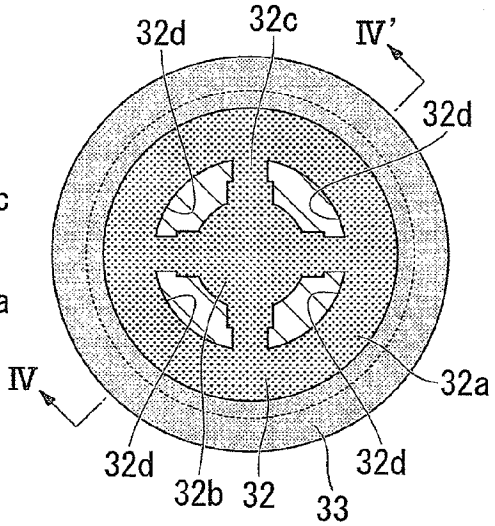
Figure 3F:
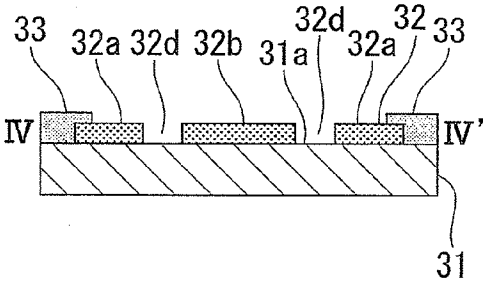
Figure 4A:
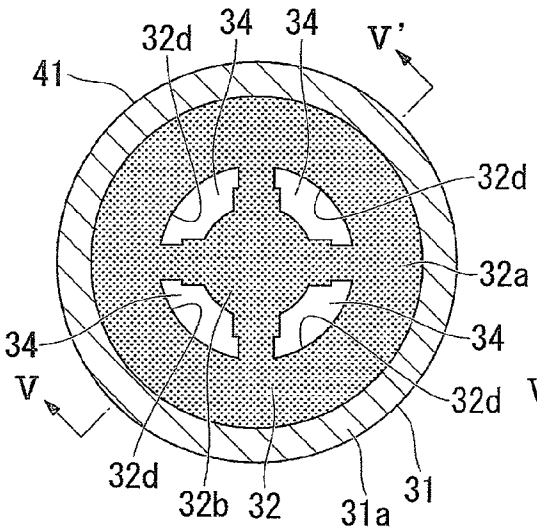
FIGS. 4(*a*)-(*f*) are explanatory views of the mechanical component manufacturing method subsequent to FIG. 3.
Figure 4C:
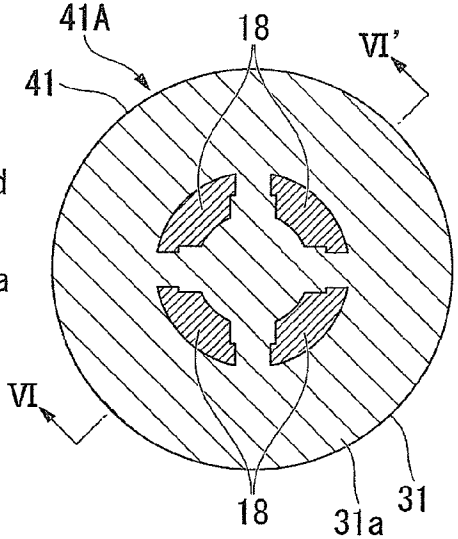
Figure 4E:
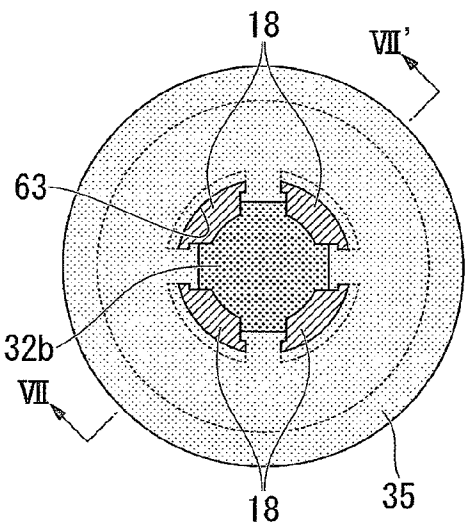
Figure 4B:
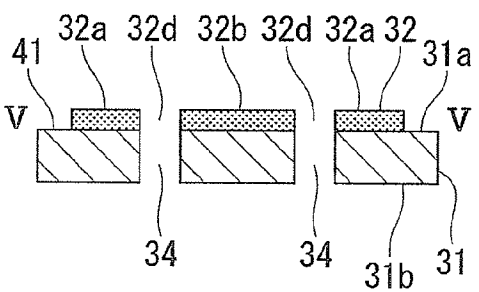
Figure 4D:
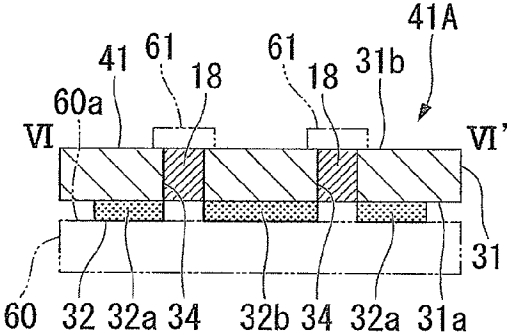
Figure 4F:
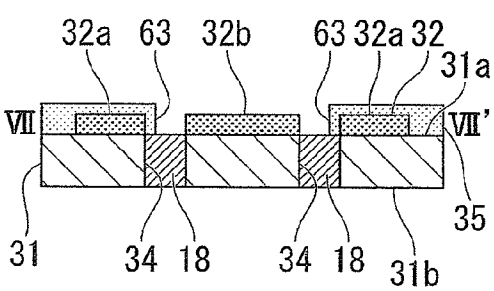
Figure 5A:
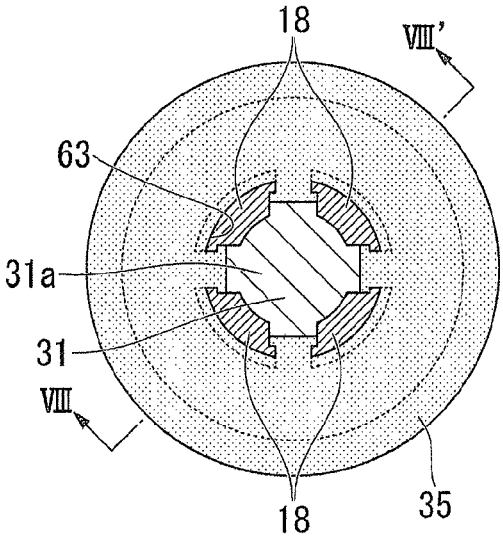
FIGS. 5(*a*)-(*d*) are explanatory views of the mechanical component manufacturing method subsequent to FIG. 4.
Figure 5C:
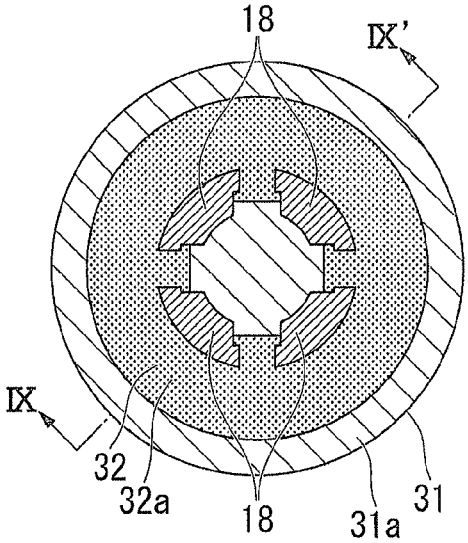
Figure 5B:
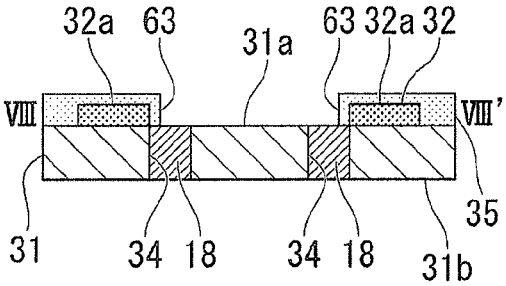
Figure 5D:
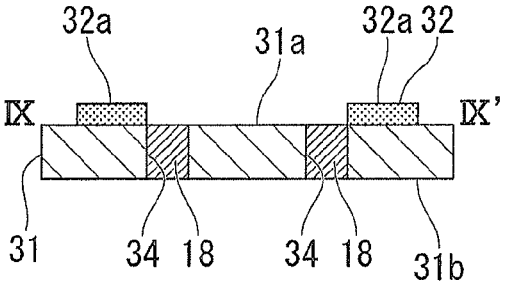
Figure 6A:
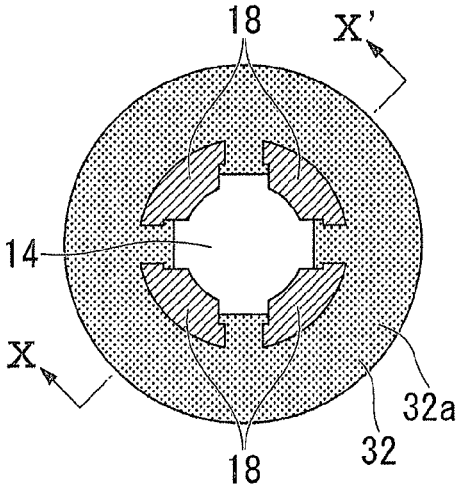
FIGS. 6(*a*)-(*d*) are explanatory views of the mechanical component manufacturing method subsequent to FIG. 5.
Figure 6C:
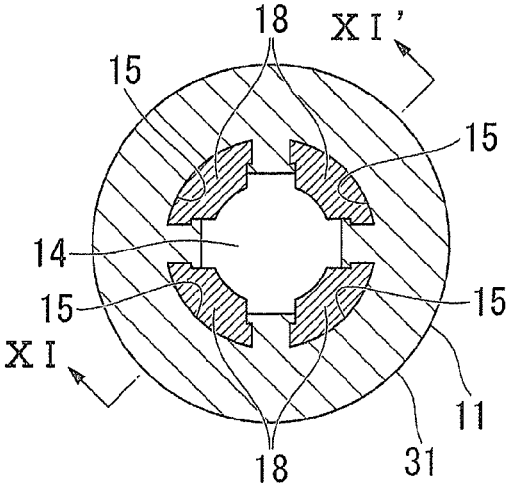
Figure 6B:
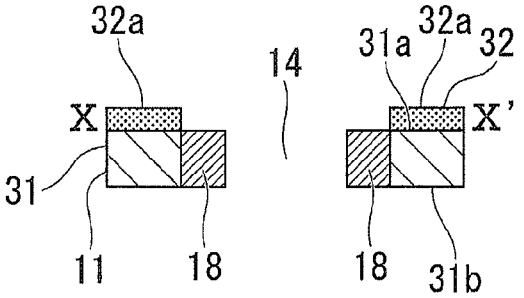
Figure 6D:
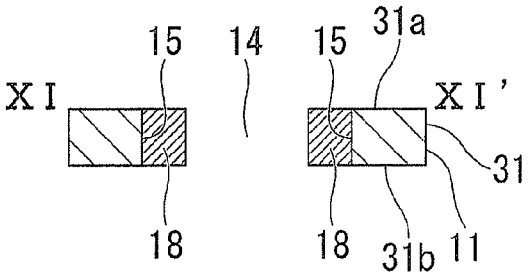

FIG. 1(*a*) is a plan view of the mechanical component 10, and FIG. 1(*b*) is an enlarged plan view of a part of the mechanical component 10. FIG. 2 is a sectional view taken along line I-I' of FIG. 1(*a*). FIG. 1 illustrates the mechanical component 10 prior to the forcing-in of a shaft member 30.

As shown in FIGS. 1 and 2, the mechanical component 10 is equipped with a substantially disc-like component main body 11, and a forcing-in portion 12 provided on the inner side of the component main body 11.

Reference numeral A1 indicates the center axis of the component main body 11, which is the rotation axis of the mechanical component 10.

In the following description, the "peripheral direction" is the peripheral direction of a circle the center of which coincides with the center axis A1 in a plane including a first surface 11*a* of the component main body 11. The "radial direction" is the radial direction of the above-mentioned circle. The "axial direction" is a direction along the center axis A1. Further, "inward" is a direction toward the center axis A1, and "outward" is a direction away from the center axis A1. Of the peripheral direction, the rotational direction to the right in FIG. 1(*a*) is referred to as the direction C1, and the rotational direction to the left is referred to as the direction C2.

As shown in FIG. 1, at the center of the component main body 11, there is formed a central hole portion 14 (through-hole) extending through the component main body 11 in the thickness direction.

At the inner peripheral edge 14*a* (inner surface) of the central hole portion 14, there are formed a plurality of retaining recesses 15 at peripheral intervals.

In planar view, each retaining recess 15 is formed in a substantially sector-shaped configuration which has an arcuate outer edge 15*a* extending in the peripheral direction and side edges 15*b*, 15*b* extending inwards from both ends of the outer edge 15*a*. The side edges 15*b*, 15*b* respectively have protrusions 16, 16 at positions spaced away from the outer edge 15*a* (positions on the inner side of the outer edge 15*a*).

In the example shown in FIG. 1, there are formed four retaining recesses 15. These retaining recesses 15 are sometimes referred to as the first through fourth retaining recesses 15A through 15D as counted clockwise.

The portions between the adjacent retaining recesses 15 are referred to as intermediate portions 17. These intermediate portions 17 are sometimes referred to as the first through fourth intermediate portions 17A through 17D as counted clockwise.

It is desirable for the retaining recesses 15 to be formed at fixed peripheral intervals. That is, it is desirable for the peripheral dimensions of the intermediate portions 17 to be equal to each other. Further, it is desirable for the peripheral dimensions of the retaining recesses 15 to be equal to each other. In the example of FIG. 1, the four retaining recesses 15 are formed at a peripheral interval of 90 degrees.

The number of retaining recesses is not restricted to that of the example shown. The number of retaining, recesses may be one or plural.

The positional relationship of the elements of the mechanical component 10 is sometimes illustrated by referring to an XY-coordinate system.

In a plane parallel to the first surface 11*a* of the component main body 11, the direction passing the center (center in the peripheral direction) of the intermediate portion 17 which is the portion between the first retaining recess 15A and the second retaining recess 15B and extending along the radial direction will be referred to as the X-direction. The direction perpendicular to the X-direction within the plane parallel to the first surface 11*a* of the component main body 11 will be referred to as the Y-direction.

The side edge 15*b* (side edge 15Ab2) on the C1-direction side of the first retaining recess 15A, the side edge 15*b* (side edge Bbl) on the C2-direction side of the second retaining recess 15B, the side edge 15*b* (side edge Cb1) on the C1-direction side of the third retaining recess 15C, and the side edge 15*b* (side edge Db1) on the C2-direction side of the fourth retaining recess 15D can be formed along the X-direction.

The side edge 15*b* (side edge 15Ab1) on the C2-direction side of the first retaining recess 15A, the side edge 15*b* (side edge Bbl) on the C1-direction side of the second retaining recess 15B, the side edge 15*b* (side edge Cb1) on the C2-direction side of the third retaining recess 15C, and the side edge 15*b* (side edge Db2) on the C1-direction side of the fourth retaining recess 15D can be formed along the Y-direction.

As shown in FIG. 1(*b*), a protrusion 16 may be, for example, of a rectangular configuration in planar view, and be forced so as to protrude in a direction perpendicular to the side edge 15*b*.

The outer edge 16*a* of the protrusion 16 is formed in a direction inclined with respect to the side edge 15*b* (perpendicular with respect to the side edge in FIG. 1(*b*)). The outer edge 16*a* is a portion where the position in the peripheral direction is greatly changed; it is also referred to as a receiving step portion 19.

At the receiving step portion 19, the peripheral dimension of the retaining recess 15 is, varied discontinuously. That is, the peripheral dimension of the retaining recess 15 is outwardly discontinuously enlarged at the receiving step portion 19.

Due to this construction, it is possible to prevent inward displacement of the shaft support portion 18 (described later), to further enhance the fixation strength of the forcing-in portion 12 with respect to the component main body 11, and to prevent rotation looseness during the operation of the mechanical component 10.

The distal end edge 16*b* of the protrusion 16 can be formed parallel to the side edge 15*b*.

The configuration in planar view of the protrusion is not restricted to the rectangular one; it may also be of a semi-circular or a triangular configuration. It is possible to form a plurality of protrusions. The plurality of protrusions may be formed in a plurality of steps.

As shown in FIG. 1(*a*), of the inner edge 14*a* of the intermediate portion 17 (inner edge 14*a* of the central hole portion 14), the inner edges 17Aa and 17Ca of the first intermediate portion 17A and the third intermediate portion 17C can be formed along the Y-direction.

The inner edges 17Ba and 17Da of the second intermediate portion 17B and the fourth intermediate portion 17D can be formed along the X-direction.

Regarding the retaining recess 15, the width dimension L1 (See FIG. 1(*a*)) at the innermost peripheral position 15*c* (the innermost position of the distal end edge 16*b* of the protrusion) (first position) (See FIG. 1(*b*)) is smaller than the width dimension L2 (See FIG. 1(*a*)) at the outermost peripheral position 15*d* (the outermost position of the side edge 15*b*) (second position) (See FIG. 1(*b*)).

The width dimension L1 is the distance between the innermost peripheral position 15*c* of one end in the peripheral direction of the retaining recess 15 and the innermost peripheral position 15*c* of the other end portion thereof. The width dimension L2 is the distance between the outermost peripheral position 15*d* of one end portion in the peripheral direction of the retaining recess 15 and the outermost peripheral position 15*d* of the other end portion thereof.

The retaining recess 15 retains the shaft support portion 18, thereby functioning as an anchor structure regulating inward and peripheral displacement of the shaft support portion 18.

Due to this structure, it is possible to prevent inward and peripheral displacement of the shaft support portion 18, so that it is possible to further enhance the fixation strength of the forcing-in portion 12 with respect to the component main body 11, and to prevent rotation looseness during the operation of the mechanical component 10.

Regarding the retaining recess, when the width dimension at the first position is smaller than the width dimension at the second position on the outer peripheral side of the first position, the first position may not be the innermost peripheral position, and the second position may not be the outermost peripheral position.

As the material of the component main body 11, a brittle material such as a ceramic material is preferable. Examples of the ceramic material that can be used include Si, SiC, $Si_3N_4$, zirconium, ruby, and carbon material.

A brittle material is a material in which the critical distortion amount of elastic deformation due to external stress is small; when the limit of elastic deformation is exceeded, there exists no yielding point, resulting in fracture; preferably, the elastic deformation range is 1% or less, and more preferably, 0.5% or less. A brittle material is of low tenacity.

It is desirable for the component main body 11 to exhibit high insulation property. When the insulation property of the component main body 11 is not sufficient, it is desirable to form an oxide film on the surface coming into contact with the shaft support portion 18.

The retaining recesses 15 (15A through 15D) have a shaft support portion 18 constituting the forcing-in portion 12.

The shaft support portion 18 fills the inner space of the retaining recess 15, and a part thereof protrudes inwards beyond the inner edge 17*a* of the intermediate portion 17 (the inner edge 14*a* of the central hole portion 14). Due to this structure, the shaft support portion 18 can reliably retain the shaft member 30.

In planar view, the shaft support portion 18 is formed in a substantially sector-shaped configuration, which has an arcuate outer edge 18*a* in contact with the outer edge 15*a*, a side edge 18*b* in contact with the side edge 15*b*, and an inner edge 18*c* extending in the peripheral direction.

Of the shaft support portion 18, the portion formed within the retaining recess 15 is referred to as the main portion 21, and the portion thereof protruding inwards beyond the inner edge 17*a* of the intermediate portion 17 is referred to as the protrusion 22.

The side edges 18*b*, 18*b* have recesses 24, 24 at positions spaced away from the outer edge 18*a* (positions nearer to the inner side than the outer edge 18*a*).

Each recess 24 has an inner edge 24*a* abutting the outer edge 16*a* of the protrusion 16, and a linear side edge 24*b* in contact with the distal end edge 16*b* of the protrusion 16.

The inner edge 24*a* is a portion where the position in the peripheral direction is changed greatly; it is also referred to as the contact step portion 25. At the contact step portion 25, the peripheral dimension of the shaft support portion 18 is discontinuously varied. That is, the peripheral dimension of the shaft support portion 18 is enlarged discontinuously outwards' at the contact step portion 25.

The inner edge 24*a* (contact step portion 25) abuts the outer edge 16*a* (receiving step portion 19) of the protrusion 16, thereby reliably preventing inward displacement of the shaft support portion 18.

In the example shown in FIG. 1, the side edge 24*b* is formed in a linear configuration parallel to the side edge 15*b*.

With the contact step portion 25 serving as a reference, the shaft support portion 18 has a portion on the outer peripheral side thereof (outer peripheral portion 28) and a portion on the inner peripheral side thereof (inner peripheral portion 29).

The outer peripheral portion 28 is of a substantially sector-shaped configuration which increases in peripheral dimension toward the outer peripheral side. The inner peripheral portion 29 is also of a substantially section-shaped configuration which increases in peripheral dimension toward the outer peripheral side.

The peripheral dimension of the shaft support portion 18 is varied discontinuously at the contact step portion 25, so that the maximum peripheral dimension of the inner peripheral portion 29 is smaller than the minimum peripheral dimension of the outer peripheral portion 28.

As shown in FIG. 2, the first surface 18*d* of the shaft support portion 18 can be formed flush with the first surface 11*a* of the component main body 11, and the second surface 18*e* of the shaft support portion 18 can be formed flush with the second surface 11*b* of the component main body 11.

A large radial dimension is advantageous for the shaft support portion 18 in enhancing the retaining force of the shaft member 30.

The shaft support portion 18 is integral with the component main body 11.

The outer diameter of the component main body 11 can, for example, be several mm to several tens mm. The thickness of the component main body 11 can, for example, be approximately 100 to 1000 μm.

The radius $r_a$ shown in FIGS. 1 and 2 is the distance from the center axis A1 to the inner edge 18*c* of the shaft support portion 18. The radius $r_b$ is the distance from the center axis A1 to the outer edge 18*a* of the shaft support portion 18.

The radius $r_c$ is the distance from the center axis A1 to the inner edge 24*a* of the recess 24 (contact step portion 25) (See FIG. 1(*b*)). More specifically, the radius $r_c$ is the distance from the center axis A1 to the distal end 24*a*1 of the inner edge 24*a*.

The radius R is the minimum distance from the center axis A1 to the inner edge 17*a* of the intermediate portion 17; in FIG. 1(*a*), it is the distance from the center axis A1 at the center of the inner edge 17*a* of the intermediate portion 17.

The radius $r_a$ of the shaft support portion 18 is smaller than the radius R of the intermediate portion 17. That is, $R>r_a$.

The difference $(R-r_a)$ between the radius R of the intermediate portion 17 and the radius $r_a$ of the shaft support portion 18 is a dimension constituting the forcing-in margin when the shaft member 30 is forced into an inner space 26 (described below); preferably, the dimension is approximately 10 μm.

The radius $r_c$ is larger than the radius $r_a$ and smaller than the radius $r_b$. That is, $r_a<r_c<r_b$.

The dimension t in the radius direction of the shaft support portion 18 is the difference between the radius $r_b$ and the radius $r_a$, $(r_b-r_a)$; preferably, the dimension is several tens μm or more.

The aspect ratio of the shaft support portion 18 (radial dimension t/axial dimension) is preferably 10 or less. By setting the aspect ratio in this range, it is possible to secure a sufficient forcing-in margin, and to easily prevent breakage of the component main body 11.

The forcing-in portion 12 is formed by four shaft support portions 18 arranged in the peripheral direction. The configuration of these shaft support portions 18 may be likened to an annular body divided into four different portions at four different peripheral positions.

By forming the forcing-in portion 12 in a divisional configuration, peripheral displacement of the forcing-in portion 12 does not easily occur, and the fixation strength of the forcing-in portion 12 with respect to the component main body 11 is further enhanced, making it possible to prevent rotation looseness during the operation of the mechanical component 10. Thus, it is possible to reliably transmit the torque of the shaft member 30 to the component main body 11.

The divisional number of the shaft support portions is 1 or more; preferably, 2 or more; and, more preferably, 3 or more. When the divisional number is 1, the shaft support portion is substantially of a C-shaped configuration; when the divisional number is 2, the shaft support portions are two arcuate portions opposite each other.

The shaft support portion 18 is formed of a metal material. It is desirable for the metal material to be one capable of plastic flow and allowing formation through electroforming.

Examples of such a metal material include Au, Ni, Cu, and an alloy thereof. Examples of the alloy include an Ni allow (Ni—Fe, Ni—W, etc.), Cu alloy, and Au alloy.

As compared with a brittle material, a metal material is of higher bending strength, tensile strength, ductility, and critical distortion, and of lower fragility, so that, when the shaft member 30 is forced in, breakage of the mechanical component 10 does not easily occur.

The shaft member 30 can be forced into the space 26 on the inner side of the inner edge 18*c* of the shaft support portion 18 (inner space 26).

When the shaft member 30 is forced in, the shaft support portion 18 is outwardly pressed to undergo plastic deformation in the compressing direction; at the same time, the inner edge 18*c* of the shaft support portion 18 retains the shaft member 30, whereby the mechanical component 10 is fixed to the shaft member 30.

The diameter of the shaft member 30 may, for example, be approximately several tens to 500 μm.

After being mounted to the shaft member 30, the shaft support portion 18 may be bonded to the shaft member 30. Examples of the bonding method that can be adopted include laser welding, soldering, diffusion bonding, brazing, eutectic bonding, thermo-compression bonding, bonding by adhesive, and bonding by wax.

In the mechanical component 10, there is formed in the component main body 11 the retaining recess 15 which is an anchor structure regulating displacement of the forcing-in portion 12, so that it is possible to enhance the fixation strength of the forcing-in portion 12 with respect to the component main body 11. Thus, it is possible to make it difficult for rotation looseness to occur during the operation of the mechanical component 10. Thus, it is possible to transmit the torque of the shaft member 30 reliably to the component main body 11, making it possible to improve the timekeeping accuracy of the timepiece employing the mechanical component 10.

Further, a part of the forcing-in portion 12 is retained by the retaining recess 15, so that it is possible to enlarge the radial dimension (thickness) of the forcing-in portion 12 at this portion. As a result, it is possible to secure a sufficient forcing-in margin, and to enhance the buffer effect. Thus, even when a brittle material is used for the component main body 11, it is possible to prevent breakage of the mechanical component 10 due to the stress when the shaft member 30 is forced in.

Further, it is possible to enlarge the radial dimension (thickness) of the forcing-in portion 12, so that it is possible to make it difficult for separation of the forcing-in portion 12 to occur.

Further, since it is formed of a metal material, the forcing-in portion 12 can be formed through electroforming. As a result, it is possible to form the forcing-in portion 12 without allowing the metal material to adhere to the outer peripheral surface of the component main body 11, so that there is no fear of the outer diameter dimension of the mechanical component 10 being enlarged. Thus, it is possible to enhance the dimensional precision of the mechanical component 10, and to improve the timekeeping accuracy of the timepiece.

First Embodiment, Mechanical Component Manufacturing Method

Next, a method of manufacturing the mechanical component 10 of the first embodiment will be described with reference to FIGS. 3 through 6.

In FIG. 3, portions (a), (c), and (e) are plan views, and portions (b), (d), and (f) are sectional views taken respectively along lines and IV-IV'. In FIG. 4, portions (a), (c), and (e) are plan views, and portions (b), (d), and (f) are sectional views taken respectively along lines V-V', VI-VI', and VII-VII' in portions (a), (c), and (e). In FIG. 5, portions (a) and (c) are plan views, and portions (b) and (d) are sectional views taken respectively along lines VIII-VIII' and IX-IX'. In FIG. 6, portions (a) and (c) are plan views, and portions (b) and (d) are sectional views taken respectively along lines X-X' and XI-XI'.

The manufacturing method of the present embodiment includes the step of preparing a mold 41, the step of forming the forcing-in portion 12 in the mold 41 through electroforming, and the step of removing unnecessary portions.

(1) Preparation of Mold

As shown in FIGS. 3(*a*) and 3(*b*), there is prepared a base member 31 formed of Si or the like.

Next, as shown in FIGS. 3(*c*) and 3(*d*), there is formed on at least one surface of the base member 31 (here, the first surface 31*a*) a first mask 32 formed of an oxide such as $SiO_2$.

The first mask 32 has an annular main body portion 32*a*, a central portion 32*b* formed on the inner side of the main body portion 32*a* so as to be spaced away from the main body portion 32*a*, and a plurality of connecting portions 32*c* connecting them to each other.

The configuration in planar view of the main body portion 32*a*, the central portion 32*b*, and the gap portion 32*d* (the inner configuration of the first mask 32) is a configuration corresponding to the configuration of the forcing-in portion shown in FIG. 1(*a*). More specifically, it has a configuration in planar view which is the same as the configuration in planar view of the forcing-in portion 12.

The outer configuration in planar view of the first mask 32 is the same as the outer configuration in planar view of the component main body 11.

The first mask 32 can be formed by pattering through photolithography of a coating film consisting, for example, of an oxide (e.g., $SiO_2$) formed over the entire area of the first surface 31*a* of the base member 31.

The patterning of the coating film can be conducted, for example, by the following method.

The coating film is formed over the entire area of the first surface 31*a* of the base member 31, and a resist layer (not shown) is formed on the surface of this coating film. As the resist layer, a negative type photo resist may be used, or a positive type photo resist may be used.

A predetermined photo mask is arranged on the surface of the resist layer to expose the resist layer.

The configuration and dimension in planar view of the photo mask correspond to the configuration and dimension in planar view of the component main body 11 shown in FIG. 1(*a*).

The unnecessary portions are removed through the development of the resist layer, and the resist layer assumes a configuration in conformity with the first mask 32.

By removing the portion of the coating film where there is not resist layer, there is formed the first mask 32 shown in FIGS. 3(*c*) and 3(*d*). After the formation of the first mask 32, the resist layer is removed.

Next, as shown in FIGS. 3(*e*) and 3(*f*), an annular second mask 33 is formed in a region on the outer side of the outer edge of the first mask 32.

Of the first surface 31*a* of the base member 31, the region on the outer side of the first mask 32 is covered with the second mask 33. The gap portion 32*d* is not covered with the second mask 33, so that, in the gap portion 32*d*, the first surface 31*a* of the base member 31 is exposed.

As shown in FIGS. 3(*e*) and 3(*f*), a part of the second mask 33 may overlap the region including the outer edge of the first mask 32.

The second mask 33 can be formed, for example, by the resist layer. As the resist layer, a negative type photo resist may be used, or a positive type photo resist may be used.

The resist layer can be formed, for example, through patterning by photolithography. For example, by exposing the resist layer through a predetermined photo mask, and developing the same, it is possible to form the annular second mask 33 shown in FIGS. 3(*e*) and 3(*f*).

Next, as shown in FIGS. 4(*a*) and 4(*b*), the portion of the base member 31 exposed through the gap portion 32*d* of the first mask 32 is removed by dry etching or the like. As a result, there is formed in the base member 31 a through-hole 34 having a configuration and dimension in planar view in conformity with the gap portion 32*d*.

The through-hole 34 constitutes the retaining recess 15 in the post-process.

In this process, the region on the outer side of the first mask 32 is covered with the second mask 33, so that this region is not removed.

By removing the second mask 33, there is obtained a mold 41 in which the first mask 32 is formed on the surface of the base member 31 having the through-hole 34.

The etching employed in the manufacturing method of the present embodiment may be a dry etching such as reactive ion etching (RIE), or a wet etching using an aqueous solution of buffer fluoric acid (BHF). As RIE, deep reactive ion etching (DRIE) is preferable.

(2) Formation of the Forcing-in Portion

As shown in FIGS. 4(*c*) and 4(*d*), the mold 41 is fixed to the surface 60*a* of a substrate 60 through adhesion or the like. In this process, the mold 41 is in an attitude in which the first surface 31*a* of the base member 31 faces the substrate 60. The substrate 60 and the mold 41 fixed thereto are referred to as the mold 41A with substrate. The substrate 60 may have on the surface 60*a* a conductive film (not shown) formed of metal or the like; or the substrate 60 itself may be formed of a conductive material.

In FIGS. 4(*c*) and 4(*d*), the mold 41 is in an attitude in which the first surface 31*a* faces downwards.

Within the gap portion 32*d* of the mold 41, there is formed the shaft support portion 18 of a metal material. It is desirable for the shaft support portion 18 to be formed through electroforming.

Figure 7:
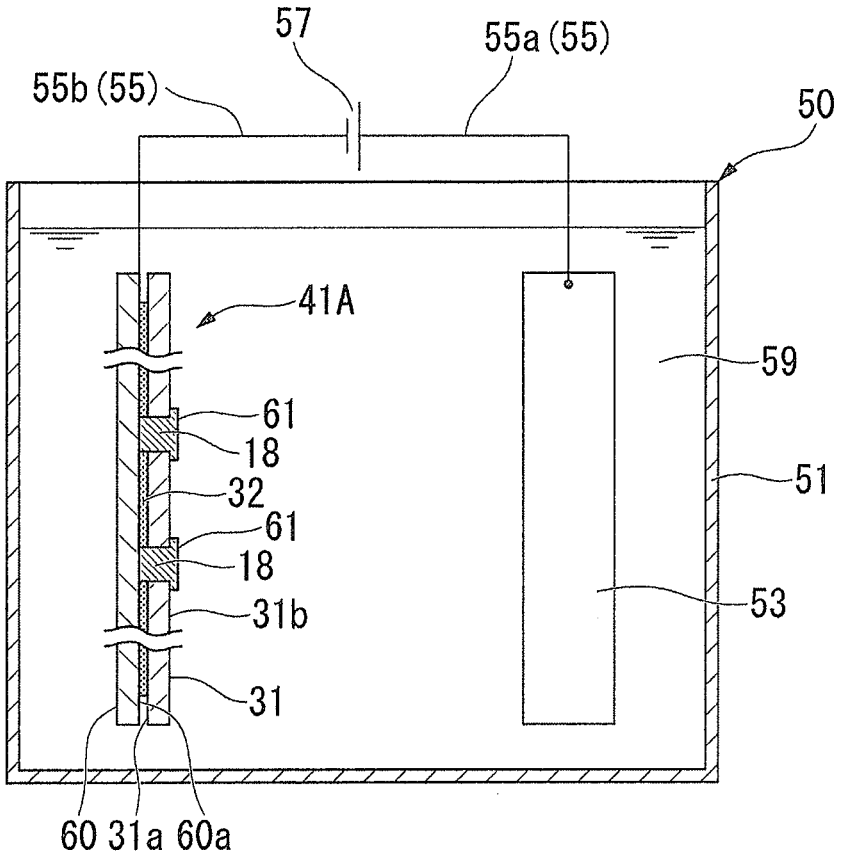
FIG. 7 is a schematic view of the construction of an electroforming apparatus.

FIG. 7 is a schematic diagram illustrating the construction of an electroforming apparatus 50 for forming the shaft support portion 18.

The electroforming apparatus 50 has an electroforming vessel 51, an electrode 53, electrical wiring 55, and a power source portion 57.

An electroforming liquid 59 is stored in the electroforming vessel 51. The electrode 53 is immersed in the electroforming liquid 59. The electrode 53 is formed by using the same metal material as the shaft support portion 18.

The electrical wiring 55 has first wiring 55*a* and second wiring 55*b*. The first wiring 55*a* connects the electrode 53 and the anode side of the power source portion 57. The second wiring 55*b* connects the mold 41A with substrate and the cathode side of the power source portion 57.

Due to this construction, the electrode 53 is connected to the anode side of the power source portion 57, and the mold 41A with substrate is connected to the cathode side thereof.

The electroforming liquid 59 is selected in accordance with the electroforming material. For example, when forming an electroforming member consisting of nickel, sulfamic acid bath, watt bath, sulfuric acid bath or the like is adopted. When performing nickel electroforming using sulfamic acid bath, there is put, for example, in the electroforming vessel 51, a sulfamic acid the main component of which is hydrated nickel sulfamate as the electroforming liquid 59.

As shown in FIG. 7, the mold 41A with substrate is set in the electroforming apparatus 50, and the power source portion 57 is operated to apply voltage between the electrode 53 and the mold 41A with substrate.

As a result, the metal (e.g., nickel) forming the electrode 53 is ionized and is migrated through the electroforming liquid 59 to be deposited in the region of the surfaces 60*a* of the substrate 60 facing the through-holes 34 of the mold 41.

As shown in FIGS. 4(*c*) and 4(*d*), the metal grows in the through-holes 34 to thereby form the shaft support portions 18. When the through-holes 34 have been filled with the metal, and the metal has grown to such a degree as to somewhat protrude from the second surface 31*b*, the application of the voltage is stopped.

Next, as indicated by phantom lines in FIG. 4(*d*), the metal of the portions (swollen portions 61) protruding from the second surface 31*b* is removed by grinding, polishing or the like. It is desirable for the metal surface to be flush with the second surface 31*b*.

More specifically, the mold 41 with the metal in the through-holes 34 is extracted from the electroforming vessel 51, and then it is possible to perform grinding/polishing on the second surface 31*b* of the mold 41, to flatten the second surface 31*b*, and to adjust the thickness of the mold 41.

As a result, the shaft support portions 18 are formed within the through-holes 34.

Then, the mold 41 is removed from the substrate 60.

(3) Removal of the Unnecessary Portions

Next, as shown in FIGS. 4(*e*) and 4(*f*), a third mask 35 having a central portion 63 is formed on the first surface 31*a* of the base member 31. The configuration and dimension in planar view of the central hole portion 63 correspond to the configuration and dimension in planar view of the central hole portion 14 shown in FIG. 1(*a*).

As the material forming the third mask 35, it is desirable to select one not damaging the shaft support portions 18 formed of metal when removing the central portion 32*b* of the first mask 32 in the next step. The third mask 35 may be formed as a resist layer or a metal layer.

In FIGS. 4(*e*) and 4(*f*), the mold 41 is in an attitude in which the first surface 31*a* faces upwards.

Next, as shown in FIGS. 5(*a*) and 5 (*b*), the central portion 32*b* of the first mask 32 is removed. To remove the central portion 32*b*, it is possible, for example, to adopt a dry etching using a fluorocarbon type gas.

Subsequently, as shown in FIGS. 5(*c*) and 5(*d*), the third mask 35 is removed by using organic solvent, $O_2$ plasma ashing, etc.

Next, as shown in FIGS. 6(*a*) and 6(*b*), the portion of the base member 31 where no first mask 32 is formed, that is, the regions situated on the inner side and the outer side of the first mask 32 in planar view is removed.

The portion of the base member 31 in the region situated on the inner side of the first mask 32 is removed, whereby the central hole portion 14 shown in FIG. 1(*a*) is formed in the base member 31.

The portion of the base member 31 in the region situated on the outer side of the first mask 32 is removed, whereby the component main body 11 of the configuration shown in FIG. 1(*a*) is obtained.

Next, as shown in FIGS. 6(*c*) and 6(*d*), the first mask 32 is removed. To remove the first mask, it is possible to adopt a dry etching using, for example, a fluorocarbon type gas.

As a result, there is obtained the mechanical component 10 shown in FIGS. 1 and 2.

In accordance with the mechanical component manufacturing method of the present embodiment, by using the common first mask 32, the forcing-in portion 12 is formed, and the outer configuration of the component main body 11 is determined, so that it is possible to enhance the coaxiality of component main body 11 with respect to the shaft member 30. Further, it is possible to enhance the dimensional precision in the radial direction.

Thus, axial deviation with respect to the shaft member 30 does not easily occur, making it possible to prevent offset during the operation of the mechanical component 10. Accordingly, it is possible to enhance the timekeeping accuracy of the timepiece using this mechanical component 10.

Specific Example of the First Embodiment, Mechanical Component

Figure 8:
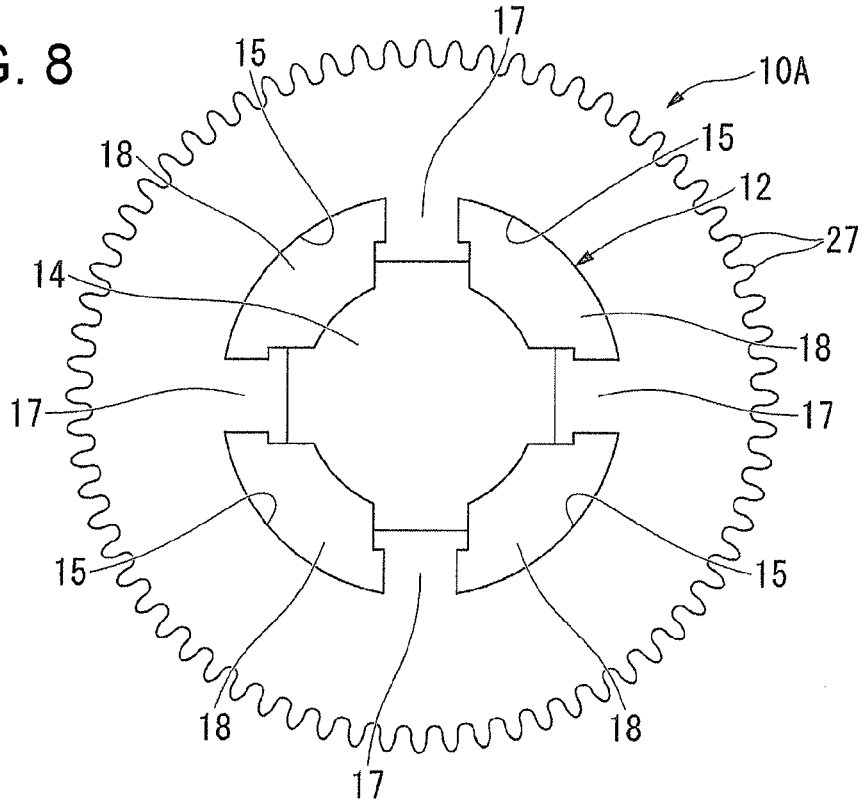
FIG. 8 is a plan view of a specific example of the mechanical component according to the first embodiment of the present invention.

FIG. 8 is a plan view of a mechanical component 10A of a specific example of the mechanical component 10 according to the first embodiment.

The mechanical component 10A is a cogwheel; at the outer peripheral edge of the mechanical component 10A, there are formed a plurality of teeth 27 protruding radially outwards. The teeth are gradually reduced in width in the protruding direction (i.e., of a tapered configuration). Due to the formation of the teeth 27, the mechanical component 10A can be brought into mesh with an adjacent cogwheel.

The cogwheel as the mechanical component 10A is used as a wheel & pinion or the like.

The mechanical component 10 is not restricted to a cogwheel like the mechanical component 10A; it may also be an escape wheel & pinion, a pallet fork, a balance wheel, etc.

Second Embodiment, Mechanical Component

A mechanical component 70 according to the second embodiment of the present invention will be described. In the following, the components that are the same as the above embodiment are indicated by the same reference numerals, and a description thereof will be left out.

Figure 9:
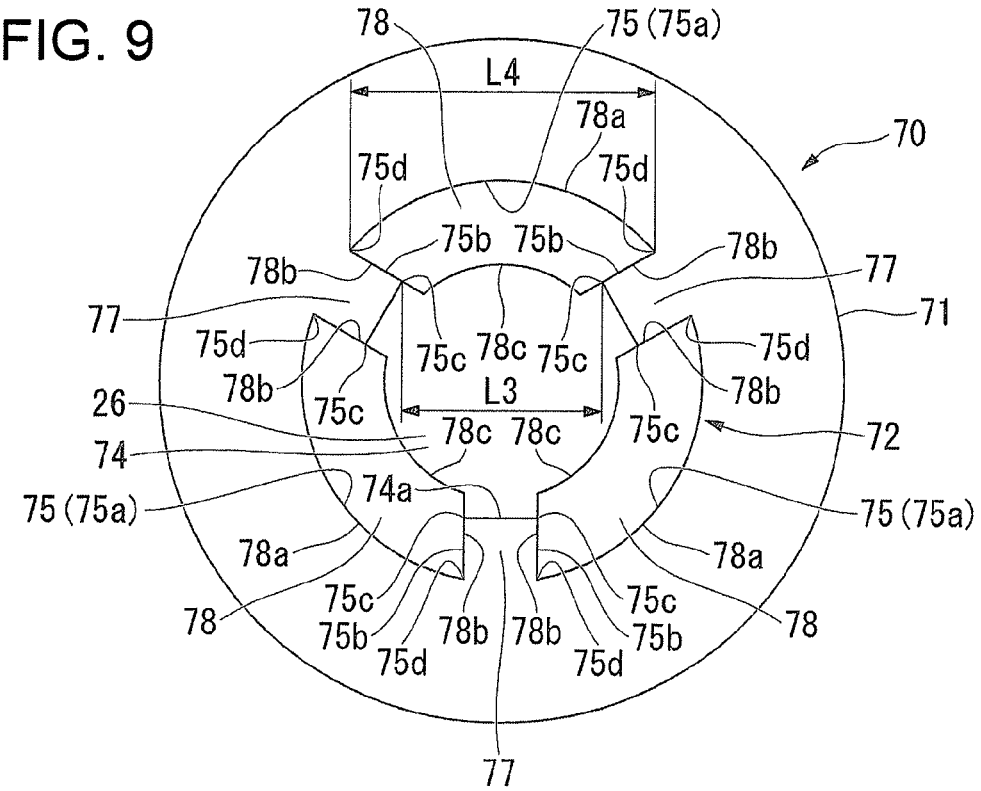
FIG. 9 is a plan view of a mechanical component according to a second embodiment of the present invention.

FIG. 9 is a plan view of the mechanical component 70.

As shown in FIG. 9, the mechanical component 70 is equipped with a substantially disc-like component main body 71, and an forcing-in portion 72 provided on the inner side of the component main body 71.

At the center of the component main body 71, there is formed a central hole portion 74 (through-hole) which is circular in planar view; at the inner edge 74*a* (inner surface) of the central hole portion 74, there are formed three retaining recesses 75 at peripheral intervals.

Each retaining recess 75 is formed substantially in a sector-shaped configuration in planar view which has an arcuate outer edge 75*a* extending in the peripheral direction, and linear side edges 75*b*, 75*b* extending inwards from both ends of the outer edge 75*a*.

Each retaining recess 75 is formed such that the width dimension L3 at the innermost peripheral position 75*c* (first position) is smaller than the width dimension L4 at the outermost peripheral position 75*d* (second position).

The retaining recess 75 functions as an anchor structure regulating inward and peripheral displacement of the shaft support portion 78 by retaining the shaft support portion 78.

The portion between the adjacent retaining recesses 75, 75 is referred to as the intermediate portion 77.

Like the component main body 11 of the first embodiment, it is desirable for the component main body 71 to be formed of a brittle material such as a ceramic material.

In the retaining recess 75, there is formed the shaft support portion 78 constituting the forcing-in portion.

The shaft support portion 78 fills the inner space of the retaining recess 75, and protrudes inwards beyond the inner edge of the intermediate portion 77.

In planar view, the shaft support portion 78 is formed in a substantially sector-shaped configuration which has an arcuate outer edge 78*a* abutting the outer edge 75*a*, a side edge 78*b* abutting the side edge 75*b*, and an inner edge 78*c* extending along the peripheral direction.

Like the shaft support portion 18 of the first embodiment, the shaft support portion 78 is formed of a metal material by electroforming.

The forcing-in portion 72 is formed by three peripherally arranged shaft support portions 78; this configuration may be obtained by dividing an annular body at three positions.

The space 26 on the inner side of the inner edge 78*c* (inner space 26) allows forcing-in of the shaft member 30 rotating the mechanical component 70.

Unlike the mechanical component 10 of the first embodiment, the mechanical component 70 has no step portions at the side edges 75*b*, 75*b*; however, the retaining recess 75 has a sufficient function as an anchor structure regulating the displacement of the forcing-in portion 72, so that it is possible to enhance the fixation strength of the forcing-in portion 72 with respect to the component main body 71. Thus, rotation looseness of the mechanical component 70 does not easily occur, making it possible to improve the timekeeping accuracy of the timepiece.

Further, as in the case of the mechanical component 10 of the first embodiment, it is possible to increase the radial dimension (thickness) of the forcing-in portion 72 without involving an increase in outer diameter, so that it is possible to enhance the buffer effect to prevent breakage of the mechanical component 70, to enhance the dimensional precision of the mechanical component 70, and to improve the timekeeping accuracy of the timepiece.

Third Embodiment, Mechanical Component

A mechanical component 80 according to the third embodiment of the present invention will be described.

Figure 10:
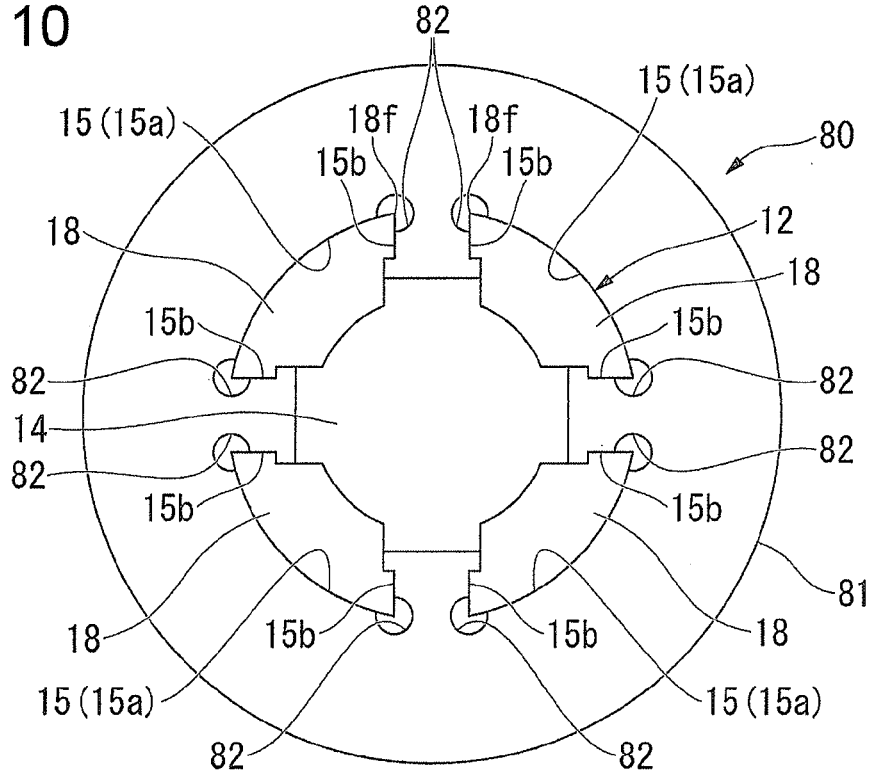
FIG. 10 is a plan view of a mechanical component according to a third embodiment of the present invention.

FIG. 10 is a plan view of the mechanical component 80.

As shown in FIG. 10, the mechanical component 80 differs from the component main body 11 shown in FIG. 1, etc. in that the component main body 81 has a receiving recess 82 receiving the swollen deformed portion of the shaft support portion 18 generated as the shaft member 30 is forced in.

The receiving recess 82 is formed from the vicinity of the end portion of the outer edge 15*a* of the retaining recess 15 to the vicinity of the outer peripheral side end of the side edge 15*b* thereof.

In the example shown in FIG. 10, the receiving recess 82 has an arcuate configuration in planar view the center of which is a corner portion 18*f* which is the intersection between the outer edge 18*a* and the side edge 18*b* of the shaft support portion 18.

The receiving recess 82 can receive the swollen deformed portion of the shaft support portion 18 generated through the application of a force to the shaft support portion 18 by the forcing-in of the shaft member 30. As a result, it is possible to mitigate the stress accompanying the forcing-in of the shaft member 30. Thus, no excessive force is easily applied to the component main body 11, making it possible to reliably prevent breakage of the component main body 11.

The forming position of the receiving recess is not restricted to that shown in FIG. 10; it may also be a position in the extending direction of either the outer edge 15*a* or the side edge 15*b*. For example, it may be formed at a central position in the peripheral direction of the outer edge 15*a*.

The planar-view configuration of the receiving recess is not restricted to the arcuate one; it may be of an arbitrary configuration such as a rectangular, semi-circular, or triangular one.

Fourth Embodiment, Mechanical Component

A mechanical component 90 according to the fourth embodiment of the present invention will be described.

Figure 11:
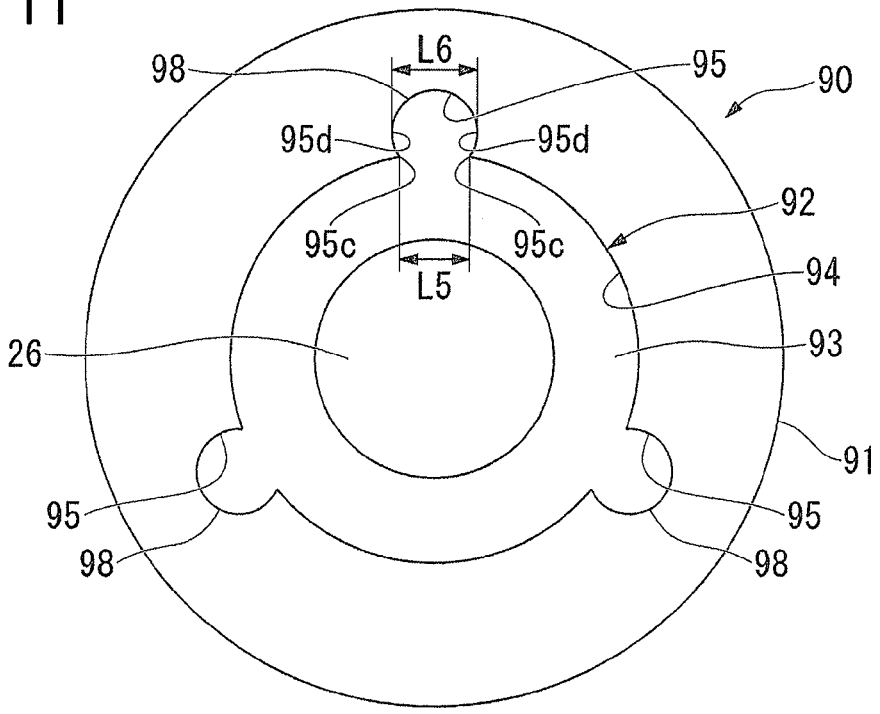
FIG. 11 is a plan view of a mechanical component according to a fourth embodiment of the present invention.

FIG. 11 is a plan view of the mechanical component 90.

As shown in FIG. 11, the mechanical component 90 is equipped with a substantially disc-like component main body 91, and a forcing-in portion 92 provided on the inner side of the component main body 91.

At the center of the component main body 91, there is formed a central hole portion 94 (through-hole) which is substantially circular in planar view; at the inner edge (inner surface) of the central hole portion 94, there are formed three retaining recesses 95 at peripheral intervals.

The retaining recesses 95 may be of an arcuate configuration in planar view. In the example shown, the center of the arcuate retaining recess 95 is on the outer side of the circle formed by the central hole portion 94, so that the width dimension L5 at the innermost peripheral position 95*c* (first position) is smaller than the width dimension L6 at the position 95*d* (second position) where the width dimension is maximum.

This retaining recess 95 retains a protrusion 98, whereby it functions as an anchor structure regulating peripheral displacement of the forcing-in portion 92. Since the width dimension L5 is smaller than the width dimension L6, the retaining recess 95 is of a structure which can also regulate the inward displacement of the forcing-in portion 92.

The forcing-in portion 92 has an annular main body portion 93 formed on the inner surface of the central hole portion 94, and a protrusion 98 protruding outwardly from the outer edge of the main body portion 93.

The protrusion 98 is formed so as to fill the inner space of the retaining recess 95, and has the same planar-view configuration as the retaining recess 95 (which is arcuate in FIG. 11).

Like the forcing-in portion 12 of the first embodiment, the forcing-in portion 92 is formed of a metal material by electroforming.

The planar-view configuration of the protrusion 98 is not restricted to the arcuate one; it may also be a rectangular, semi-circular, or triangular one.

In the mechanical component 90, the component main body 91 has a retaining recess 95 having an anchor structure regulating displacement of the forcing-in portion 92, so that it is possible to enhance the fixation strength of the forcing-in portion 92 with respect to the component main body 91. Thus, rotation looseness of the mechanical component 90 does not easily occur, making it possible to improve the timekeeping accuracy of the timepiece.

Modification of the First Embodiment, Mechanical Component

Figure 12:
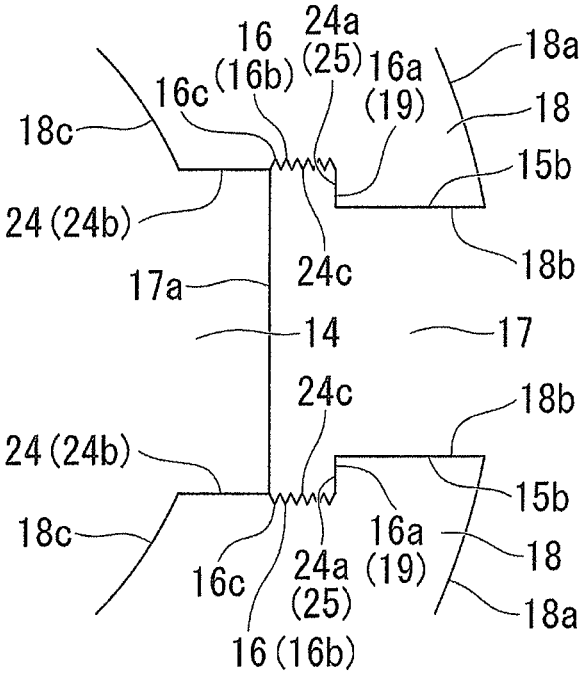
FIG. 12 is a plan view of a modification of the mechanical component according to the first embodiment of the present invention.

As shown in FIG. 12, in the mechanical component 10 of the first embodiment, first recesses and protrusions 16*c* may be formed at the distal end edge 16*b* of the protrusion 16, and second recesses and protrusions 24*c* of a configuration corresponding the first recess-protrusion structure 16*c* may be formed at the side edge 24*b* of the recess 24 of the portion abutting the same.

Through the fit-engagement between the first recesses and protrusions 16*c* and the second recesses and protrusions 24*c*, the anchor effect (which, in this example, is the effect of making it difficult for inward displacement of the shaft support portion 18) is enhanced.

First Modification of the First Embodiment, Mechanical Component

Figure 13:
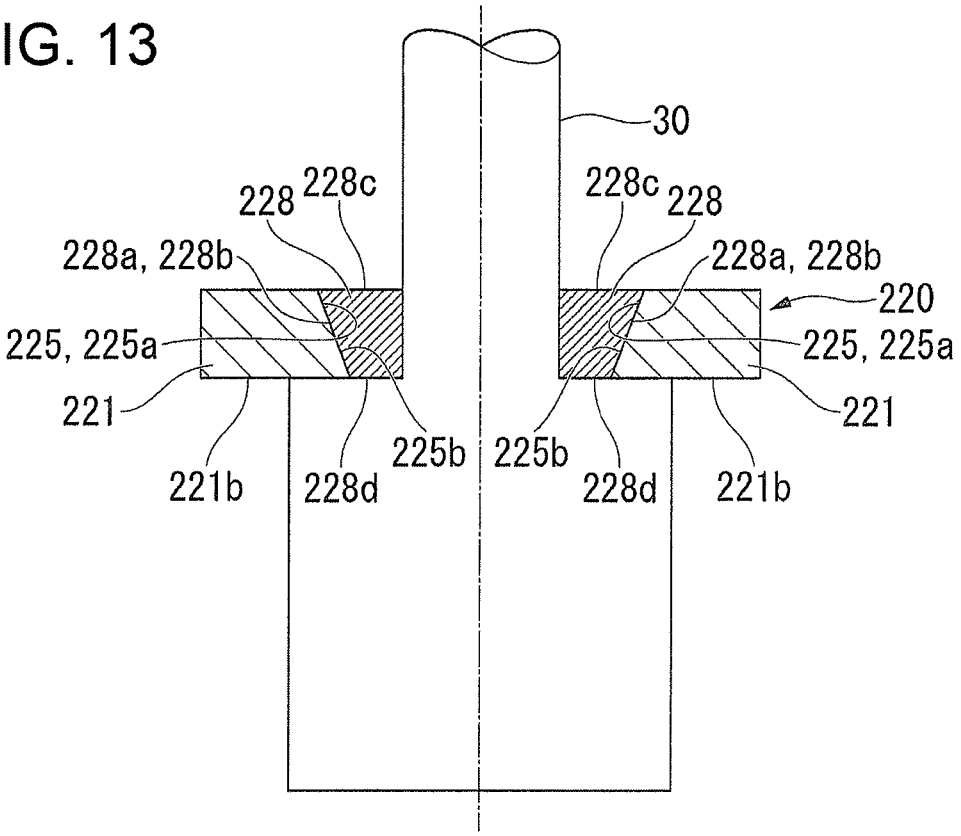
FIG. 13 is a schematic sectional view of a first modification of the mechanical component of FIG. 1.

FIG. 13 is a sectional view schematically illustrating a mechanical component 220 which is the first modification of the mechanical component 10 of the first embodiment. Like FIG. 2, FIG. 13 is a sectional view taken along a line passing the center axis of the mechanical component 220, the retaining recess, and the shaft support portion (See line I-I' of FIG. 1(*a*)).

The inner surface 225*b* of the peripheral edge 225*a* of the retaining recess 225 is an inclined surface inclined at a fixed angle so as to be reduced in diameter from the first surface 221*a* to the second surface 221*b*.

The shaft support portion 228 has a structure regulating displacement in the thickness direction (with respect to the component main body 221). More specifically, the outer surface 228*b* of the outer edge 228*a* of the shaft support portion 228 is an inclined surface inclined at a fixed angle so as to be reduced in diameter from the first surface 228*c* to the second surface 228*d*, and abuts the inner surface 225*b* over the entire surface.

The outer diameter at the first surface 228*c* of the shaft support portion 228 (maximum outer diameter) is larger than the inner diameter at the second surface 221*b* of the retaining recess 225 (minimum inner diameter), so that downward movement of the shaft support portion 228 (movement of the component main body 221 in the thickness direction) is regulated.

Due to this structure, the mechanical component 220 prevents detachment of the shaft support portion 228, making it possible to enhance the durability thereof.

Second Modification of the First Embodiment, Mechanical Component

Figure 14:
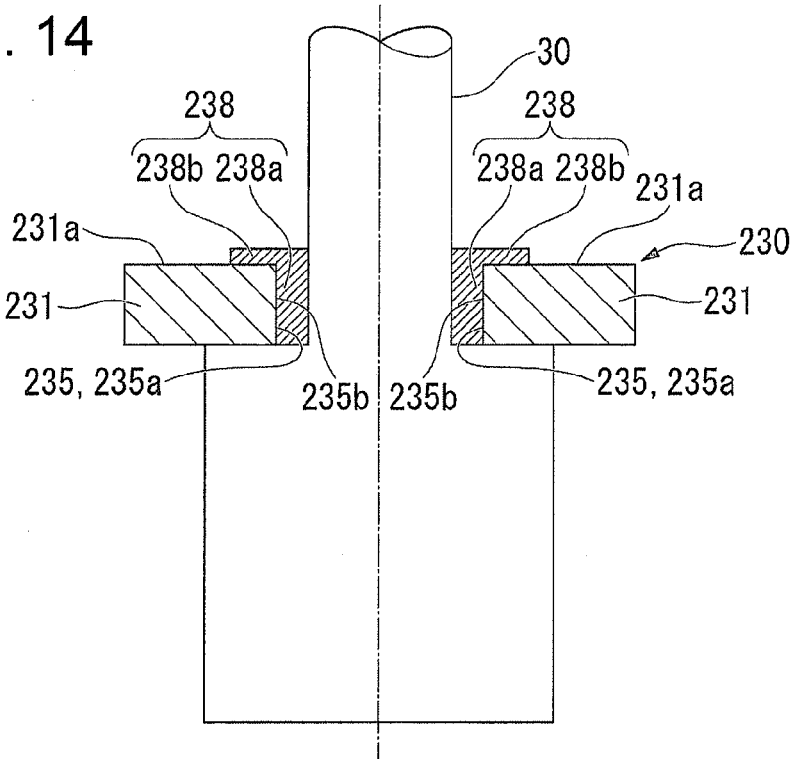
FIG. 14 is a schematic sectional view of a second modification of the mechanical component of FIG. 1.

FIG. 14 is a schematic sectional view of a mechanical component 230 which is a second modification of the mechanical component 10 of the first embodiment.

A shaft support portion 238 is of a structure regulating displacement in the thickness direction (with respect to the component main body 231). More specifically, the shaft support portion 238 has a structure of an L-shaped sectional configuration consisting of a main body portion 238*a* and an outer extension portion 238*b*.

The main body portion 238*a* is provided on the inner surface 235*b* of a peripheral edge 235*a* of a retaining recess 235. The outer extension portion 238*b* extend radially outwards from the end portion on the first surface 231*a* side of the main body portion 238*a* along the first surface 231*a* of the component main body 231.

The shaft support portion 238 is regulated in downward movement (movement in the thickness direction of the component main body 231) by the first surface 231*a* in contact with the outer extension portion 238*b*.

Due to this structure, the mechanical component 230 prevents detachment of the shaft support portion 238, making it possible to enhance the durability thereof.

Third Modification of the First Embodiment, Mechanical Component

Figure 15:
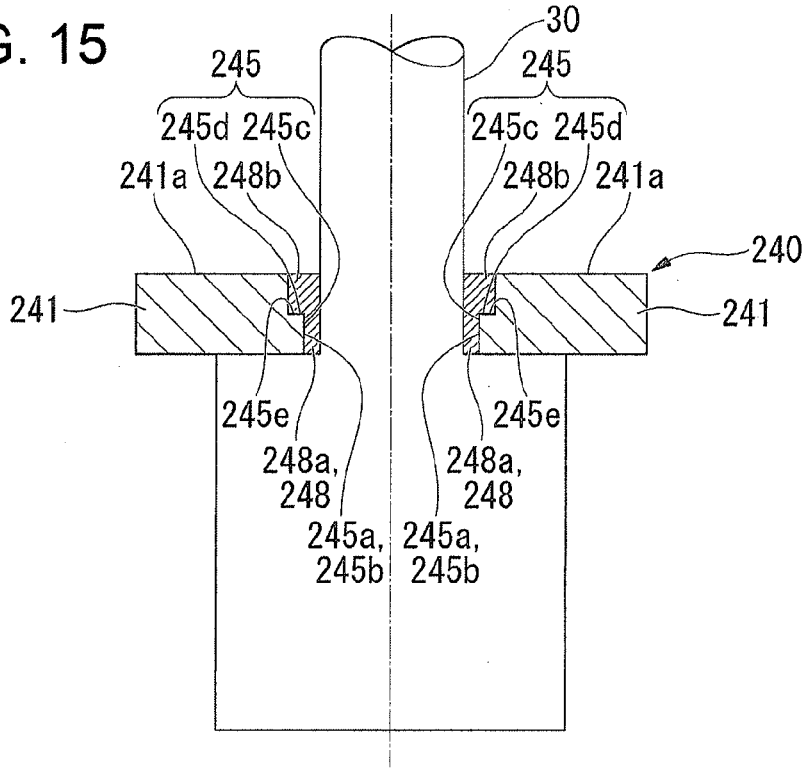
FIG. 15 is a schematic sectional view of a third modification of the mechanical component of FIG. 1.

FIG. 15 is a schematic sectional view of a mechanical component 240 which is a third modification of the mechanical component 10 of the first embodiment.

A retaining recess 245 has a main portion 245*c* and a first surface recess 245*d*. The main portion 245*c* is formed on an inner surface 245*b* of a peripheral edge 245*a* of the retaining recess 245. The first surface recess 245*d* is formed on the first surface 241*a* of the component main body 241.

A shaft supporting portion 248 is of a structure regulating displacement in the thickness direction (with respect to the component main body 241). More specifically, the shaft support portion 248 has a main body portion 248*a* and an outer extension portion 248*b*.

The main body portion 248*a* is provided on the main portion 245*c* over the entire thickness, direction of the component main body 241. The outer extension portion 248*b* protrudes radially outwards from the first surface 241*a* side portion of the main body portion 248*a*. The outer extension portion 248*b* is formed thinner than the component main body 241, and is formed in a part of the thickness range of the component main body 241 (the thickness range from an intermediate position in the thickness direction to the first surface 241*a*); it is situated within the first surface recess 245*d*.

Since the outer extension portion 248*b* is formed within the first surface recess 245*d*, the shaft support portion 248 is regulated in downward movement (movement in the thickness direction of the component main body 241) by the bottom portion 245*e* of the retaining recess 245.

Due to this structure, the mechanical component 240 prevents detachment of the shaft support portion 248, making it possible to enhance the durability thereof.

Fourth Modification of the First Embodiment, Mechanical Component

Figure 16:
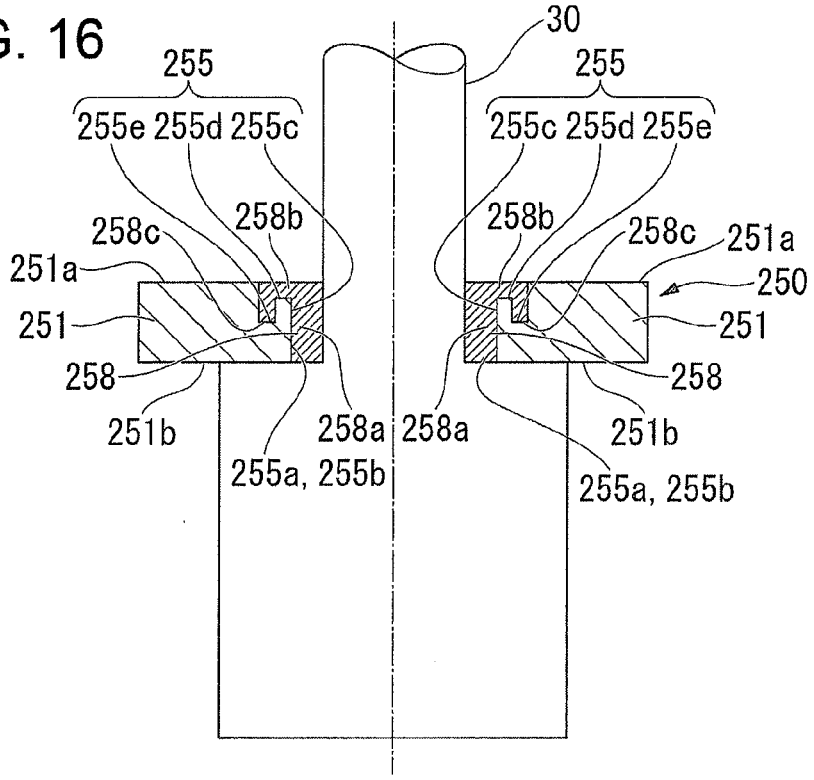
FIG. 16 is a schematic sectional view of a fourth modification of the mechanical component of FIG. 1.

FIG. 16 is a schematic sectional view of a mechanical component 250 which is a fourth modification of the mechanical component 10 of the first embodiment.

A retaining recess 255 formed in a component main body 251 has a main portion 255*c*, a first surface recess 255*d* formed in a first surface 251*a*, and an outer edge recess 255*e* formed at the outer edge portion of the first surface recess 255*d*.

The main portion 255*c* is formed on an inner surface 255*b* of a peripheral edge 255*a* of the retaining recess 255. The outer edge recess 255*e* is formed at the bottom surface of the outer edge portion of the first surface recess 255*d* as a recess facing a second surface 251*b*.

A shaft support portion 258 is of a structure regulating displacement in the thickness direction (with respect to the component main body 251). More specifically, the shaft support portion 258 has a main body portion 258*a*, an outer extension portion 258*b*, and an outer edge protrusion 258*c*.

The main body portion 258*a* is provided on the main portion 255*c* over the entire thickness direction of the component main body 251. The outer extension portion 258*b* protrudes radially outwards from the first surface 251*a* side portion of the main body portion 258*a*, and is formed within the first surface recess 255*d*. The outer edge protrusion 258*c* protrudes from the outer edge portion of the outer extension portion 258*b* toward the second surface 251*b*, and is formed within the outer edge recess 255*e*.

The shaft support portion 258 is regulated in downward movement (movement in the thickness direction of the component main body 251) by the bottom portion of the first surface recess 255*d* and the bottom portion of the outer edge recess 255*e*.

Due to this structure, the mechanical component 250 prevents detachment of the shaft support portion 258, and can enhance the durability thereof.

Fifth Modification of the First Embodiment, Mechanical Component

Figure 17:
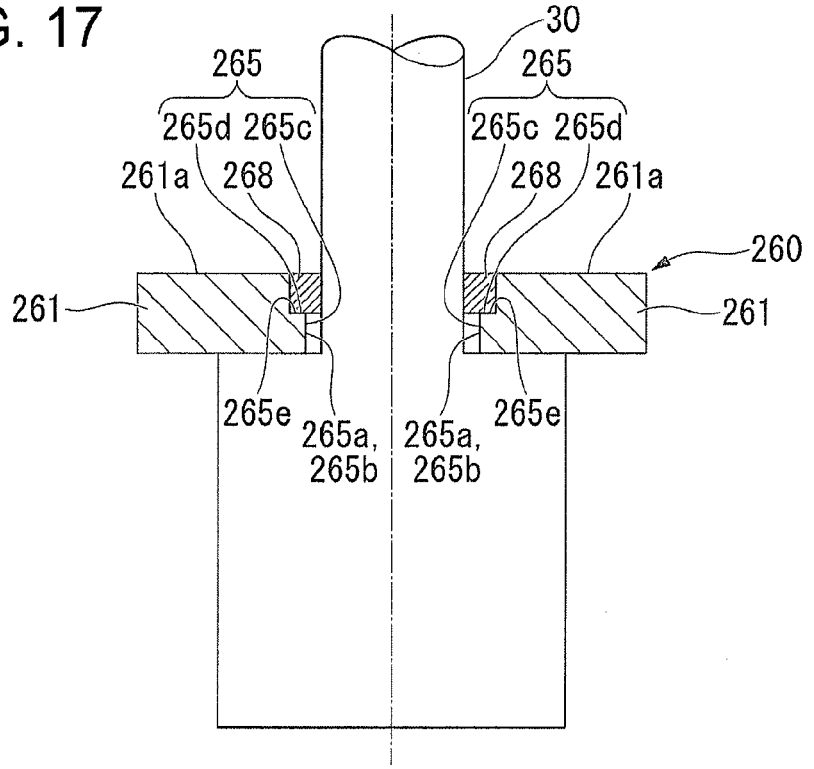
FIG. 17 is a schematic sectional view of a fifth modification of the mechanical component of FIG. 1.

FIG. 17 is a schematic sectional view of a mechanical component 260 which is a fifth modification of the mechanical component 10 of the first embodiment.

A retaining recess 265 has a main portion 265*c*, and a first surface recess 265*d*. The main portion 265*c* is formed on the inner surface 265*b* of the peripheral edge 265*a* of the retaining recess 265. The first surface recess 265*d* is formed on a first surface 261*a* of a component main body 261.

A shaft support portion 268 is of a structure regulating displacement in the thickness direction (with respect to the component main body 261). More specifically, the shaft support portion 268 is formed thinner than the component main body 261, and is formed in a part of the thickness range of the component main body 261 (the thickness range from the intermediate position in the thickness direction to the first surface 261*a*). The shaft support portion 268 has a fixed thickness in the radial direction. The portion of the shaft support portion 268 including the outer edge is formed within the first recess 265*d*.

Since a part of it is formed within the first surface recess 265*d*, the shaft support portion 268 is regulated in downward movement (movement in the thickness direction of the component main body 261) by the bottom portion 265*e* of the retaining recess 265.

Due to this structure, the mechanical component 260 prevents detachment of the shaft support portion 268, and can enhance the durability thereof.

In the following, a movement and a timepiece according to an embodiment of the present invention will be described with reference to the drawings. In the drawings referred to, the scale of each member is changed as appropriate so that each member may be large enough to be recognizable.

Generally speaking, the mechanical body including the drive portion of a timepiece is referred to as the "movement." A dial and hands are mounted to the movement, and the complete product obtained by putting the whole in a timepiece case is referred to as the "complete" of the timepiece. Of both sides of a main plate constituting the base plate of the timepiece, the side where the windshield of the timepiece case exists, that is, the side where the dial exists is referred to as the "back side" or "dial side" of the movement. Of the two sides of the main plate, the side where the case back of the timepiece exists, that is, the side opposite the dial is referred to as the "front side" or "case back side" of the movement.

Figure 18:
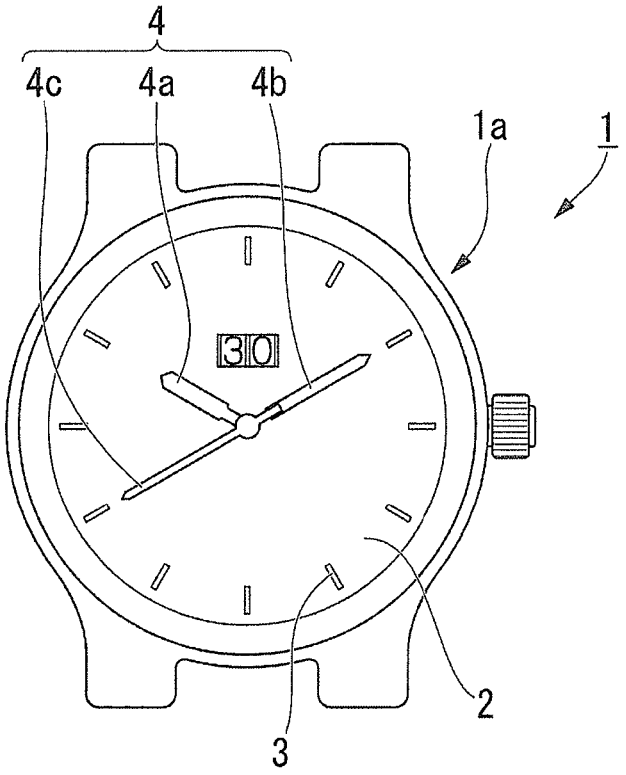
FIG. 18 is a plan view of a complete according to an embodiment of the present invention.

FIG. 18 is a plan view of a complete.

As shown in FIG. 18, a complete 1*a* of a timepiece 1 is equipped with a dial 2 having a scale 3, etc. indicating information regarding time, and hands 4 including an hour hand 4*a* indicating hour, a minute hand 4*b* indicating minute, and a second hand 4*c* indicating second.

Figure 19:
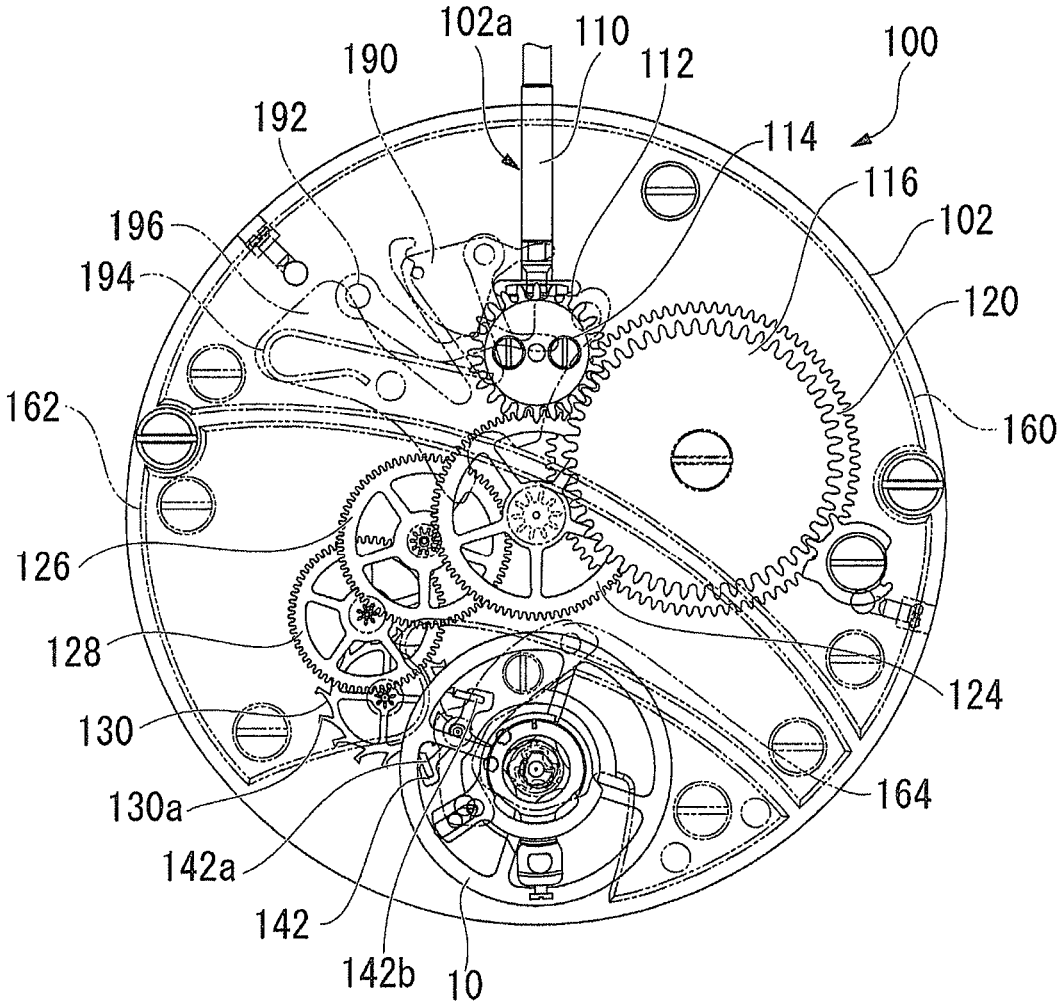
FIG. 19 is a plan view of the front side of a movement according to an embodiment of the present invention.

FIG. 19 is a plan view of the front side of a movement. In FIG. 19, in order that the drawing may be easy to see, part of the timepiece components constituting the movement 100 are omitted.

The movement 100 of the mechanical timepiece has a main plate 102 constituting the base plate. A winding stem 110 is rotatably incorporated into a winding stem guide hole 102*a* of the main plate 102. The position in the axial direction of this winding stem 110 is determined by a switching device including a setting lever 190, a yoke 192, a yoke spring 194, and a setting lever jumper 196.

And, when the winding stem 110 is rotated, a winding pinion 112 is rotated through the rotation of a clutch wheel (not shown). Through the rotation of the winding pinion 112, a crown wheel 114 and a ratchet wheel 116 are rotated successively, and a mainspring (not shown) accommodated in a movement barrel 120 is wound up.

The movement barrel 120 is rotatably supported between the main plate 102 and a barrel bridge 160. A center wheel & pinion 124, a third wheel & pinion 126, a second wheel & pinion 128, and an escape wheel & pinion 130 are rotatably supported between the main plate 102 and a train wheel bridge 162.

When the movement barrel 120 rotates due to the restoring force of the mainspring, the center wheel & pinion 124, the third wheel & pinion 126, the second wheel & pinion 128, and the escape wheel & pinion 130 rotate successively. The movement barrel 120, the center wheel & pinion 124, the third wheel & pinion 126, and the second wheel & pinion 128 constitute the front train wheel.

When the center wheel & pinion 124 rotates, a cannon pinion (not shown) rotates simultaneously based on the rotation thereof, and the minute hand 4*b* (See FIG. 18) mounted to the cannon pinion indicates "minute." Further, based on the rotation of the cannon pinion, an hour wheel (not shown) rotates via the rotation of a minute wheel (not shown), and the hour hand 4*a* (See FIG. 18) mounted to the hour wheel indicates "hour."

An escapement/governor device for controlling the rotation of the front train wheel is composed of the escape wheel & pinion 130, a pallet fork 142, and the mechanical component 10 (balance wheel).

Teeth 130*a* are formed in the outer periphery of the escape wheel & pinion 130. The pallet fork 142 is rotatably supported between the main plate 102 and a pallet bridge 164, and is equipped with a pair of pallets 142*a* and 142*b*. The escape wheel & pinion 130 is temporarily at rest with one pallet 142*a* of the pallet fork 142 being engaged with the teeth 130*a* of the escape wheel & pinion 130.

The mechanical component 10 (balance wheel) makes reciprocating rotation at a fixed cycle, whereby one pallet 142*a* and the other pallet 142*b* of the pallet fork 142 are alternately engaged and disengaged with and from the teeth 130*a* of the escape wheel & pinion 130. As a result, the escapement of the escape wheel & pinion 130 is effected at a fixed speed.

In the above construction, there is provided the mechanical component of the above-described embodiment, so that it is possible to provide a movement and a timepiece of high timekeeping accuracy.

The present invention is not restricted to the above-described embodiment but allows various modifications without departing from the scope of the gist of the present invention. That is, the concrete configuration, construction, etc. of the embodiment are only given by way of example, and allow modification as appropriate.

What is claimed is:

1. A mechanical component, comprising:

a component main body having a through-hole through which a shaft member is passed; and a forcing-in portion formed on the inner surface of the through-hole and fixed to the shaft member through the forcing-in of the shaft member, wherein a retaining recess is formed on the inner surface of the through-hole, a part of the forcing-in portion fills the inner space of the retaining recess and another part of the forcing-in portion protrudes inwardly from the inner surface of the through-hole, and the retaining recess constitutes an anchor structure regulating displacement of the forcing-in portion with respect to the component main body by retaining at least a part of the forcing-in portion; and wherein the forcing-in portion is formed of a metal material.

2. The mechanical component according to claim 1, wherein the retaining recess regulates inward displacement of the forcing-in portion by making the width dimension thereof at a first position smaller than the width dimension thereof at a second position on the outer peripheral side of the first position.

3. The mechanical component according to claim 1, wherein the retaining recess has a receiving step portion the peripheral dimension of which increases discontinuously toward the exterior; and the forcing-in portion has an abutment step portion abutting the receiving step portion.

4. The mechanical component according to claim 2, wherein the retaining recess has a receiving step portion the peripheral dimension of which increases discontinuously toward the exterior; and the forcing-in portion to has abutment step portion abutting the receiving step portion.

5. The mechanical component according to claim 1, wherein the forcing-in portion is divided at least at one position in the peripheral direction of the component main body.

6. The mechanical component according to claim 2, wherein the forcing-in portion is divided at least at one position in the peripheral direction of the component main body.

7. The mechanical component according to claim 3, wherein the forcing-in portion is divided at least at one position in the peripheral direction of the component main body.

8. The mechanical component according to claim 4, wherein the forcing-in portion is divided at least at one position in the peripheral direction of the component main body.

9. The mechanical component according to claim 1, wherein the component main body has a receiving recess receiving a swollen deformed portion of the forcing-in portion generated through the forcing-in of the shaft member.

10. The mechanical component according to claim 2, wherein the component main body has a receiving recess receiving a swollen deformed portion of the forcing-in portion generated through the forcing-in of the shaft member.

11. The mechanical component according to claim 3, wherein the component main body has a receiving recess receiving a swollen deformed portion of the forcing-in portion generated through the forcing-in of the shaft member.

12. The mechanical component according to claim 4, wherein the component main body has a receiving recess receiving a swollen deformed portion of the forcing-in portion generated through the forcing-in of the shaft member.

13. The mechanical component according to claim 5, wherein the component main body has a receiving recess receiving a swollen deformed portion of the forcing-in portion generated through the forcing-in of the shaft member.

14. The mechanical component according to claim 6, wherein the component main body has a receiving recess receiving a swollen deformed portion of the forcing-in portion generated through the forcing-in of the shaft member.

15. The mechanical component according to claim 1, wherein the forcing-in portion has a displacement regulating structure regulating displacement in the thickness direction with respect to the component main body.

16. The mechanical component according to claim 1, wherein the component main body is formed of a brittle material.

17. A movement equipped with a mechanical component as claimed in claim 1.

18. A timepiece equipped with a movement as claimed in claim 17.

* * * * *